US012228368B1

(12) United States Patent
Liu

(10) Patent No.: US 12,228,368 B1
(45) Date of Patent: Feb. 18, 2025

(54) BAND HOLSTER FOR QUICK DRAW

(71) Applicant: SHENZHEN EGOTOP TECHNOLOGY CO.,LTD, Shenzhen (CN)

(72) Inventor: Ou Liu, Shenzhen (CN)

(73) Assignee: SHENZHEN EGOTOP TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 18/665,568

(22) Filed: May 16, 2024

(30) Foreign Application Priority Data

Apr. 17, 2024 (CN) ..... 202420807393.6

(51) Int. Cl.
*F41C 33/02* (2006.01)
*A45F 3/14* (2006.01)
*F41C 33/04* (2006.01)

(52) U.S. Cl.
CPC ..... *F41C 33/0272* (2013.01); *A45F 3/14* (2013.01); *F41C 33/0218* (2013.01); *F41C 33/048* (2013.01); *A45F 2003/142* (2013.01)

(58) Field of Classification Search
CPC . F41C 33/330272; F41C 33/0218; A45F 3/14
USPC ..... 224/587
See application file for complete search history.

(56) References Cited

U.S. PATENT DOCUMENTS 4,579,265 A * 4/1986 Schiller ..... A45C 1/04 224/587
4,750,655 A * 6/1988 Barry ..... F41C 33/0227 224/911
5,018,653 A * 5/1991 Shoemaker ..... F41C 33/045 D3/222
5,236,113 A * 8/1993 Wisser ..... F41C 33/0227 224/242
5,240,156 A * 8/1993 Sicotte ..... A45F 5/02 224/583
5,282,559 A * 2/1994 Wisser ..... F41C 33/045 224/193
5,294,031 A * 3/1994 Volpei ..... F41C 33/048 224/664
5,894,976 A * 4/1999 Harper ..... A45F 5/00 224/660
5,909,834 A * 6/1999 Parrott, III ..... F41C 33/048 224/660
6,176,402 B1 * 1/2001 Rogers ..... F41C 33/046 224/267
D725,383 S * 3/2015 Gazso ..... D3/222
D753,913 S * 4/2016 Galoob ..... D3/222
9,320,344 B2 * 4/2016 Barbier ..... A45C 11/00
D761,553 S * 7/2016 Scott ..... D3/222
9,581,414 B1 * 2/2017 Mironski ..... F41C 33/046
9,958,233 B2 * 5/2018 Considine ..... F41C 33/0209
10,962,326 B2 * 3/2021 Mills ..... F41C 33/048
11,022,402 B1 * 6/2021 Scott ..... F41C 33/048
(Continued)

*Primary Examiner* — Scott T McNurlen
*Assistant Examiner* — Lester L Vanterpool
(74) *Attorney, Agent, or Firm* — Ying-Ting Chen

(57) ABSTRACT

A band holster for quick draw include a band body, a handgun pouch connected to the band body for holding a handgun, and a clasp means which is capable of being operated between a closed state for retaining the handgun at the handgun pouch and an open state for allowing the handgun to be retrieved from the handgun pouch by a single drawing operation of a single hand.

1 Claim, 26 Drawing Sheets

(56) References Cited

U.S. PATENT DOCUMENTS

| | | | | |
|---|---|---|---|---|
| 11,054,215 | B2 * | 7/2021 | Foster | F41C 33/043 |
| D937,569 | S * | 12/2021 | Tang | D3/224 |
| 11,419,367 | B1 * | 8/2022 | Hogstad | F41C 33/0209 |
| 11,460,269 | B2 * | 10/2022 | Cochran | F41C 33/048 |
| 11,561,065 | B1 * | 1/2023 | Hoffman | F41C 33/046 |
| 11,709,034 | B1 * | 7/2023 | Goldstein | F41C 33/0209 224/183 |
| 2011/0226825 | A1 * | 9/2011 | Sanford | F41C 33/0218 224/243 |
| 2015/0233670 | A1 * | 8/2015 | Galoob | F41C 33/046 224/587 |
| 2015/0366280 | A1 * | 12/2015 | Fay | A41D 27/205 2/248 |
| 2016/0061563 | A1 * | 3/2016 | Bowman | F41C 33/0209 224/587 |
| 2016/0209164 | A1 * | 7/2016 | Fravala | F41C 33/048 |
| 2016/0265875 | A1 * | 9/2016 | Malcolm | F41C 33/048 |
| 2017/0354197 | A1 * | 12/2017 | Marker | A43B 3/02 |

* cited by examiner

A

B

C

D

BAND HOLSTER FOR QUICK DRAW

CROSS REFERENCE OF RELATED APPLICATION

This application is a non-provisional application that claims priority under 35U.S.C. § 119 to China application number CN202420807393.6, filing date Apr. 17, 2024, wherein the entire content of which is expressly incorporated herein by reference.

BACKGROUND OF THE PRESENT INVENTION

Field of Invention

The present invention relates to a holster, and more particularly to a band holster which allows for quick firearm retrieval through a single drawing operation.

Description of Related Arts

When engaging in outdoor activities like running, jogging, or hiking, carrying a firearm can be essential for personal safety. These activities often take place in remote or isolated areas where encounters with wildlife or potential threats from other individuals can occur unexpectedly. Having a firearm provides a means of defense against such dangers, offering peace of mind and a sense of security while enjoying the outdoors. Additionally, in some areas where wild animal encounters are common, carrying a firearm can serve as a deterrent, reducing the risk of confrontations and ensuring the safety of both the individual and any accompanying companions. Overall, for those who enjoy outdoor activities, carrying a firearm can be a crucial aspect of being prepared and staying safe while exploring nature.

In addition, unlike open carrying, which may attract attention and potentially cause discomfort to others, concealed firearms are hidden from view, allowing individuals to maintain their privacy and go about their daily activities without drawing unnecessary attention. Concealed firearms provide individuals with a means of self-defense in potentially dangerous situations. In cases of attempted robbery, assault, or other violent encounters, a concealed firearm can offer a crucial advantage in protecting oneself and others. Carrying a concealed firearm can provide individuals with a sense of empowerment and self-reliance. Knowing that they have the means to defend themselves can boost confidence and reduce feelings of vulnerability, particularly in unfamiliar or high-risk environments, because the concealed firearms allow for a swift response to immediate threats and individuals can take action to protect themselves and others from harm.

However, a conventional belt holster requires users to perform at least two actions to open the pocket and retrieve the handgun. In other words, such a design often requires users to perform additional operations, such as locating the position of the VELCRO™ or aligning the button, and then opening the VELCRO™ or button, and finally pulling out the handgun from the pocket, this affects the speed of retrieving the handgun.

Referring to FIGS. 1 to 2B of the drawings, a conventional belt holster includes a belt body 1, a holster pocket 2 attached to the belt body 1 for receiving a handgun, and a button clip 3 adapted for retaining the handgun in the holster pocket 2. As shown in FIG. 1, the clipping position of the button clip 3 is at an outer side of the holster pocket 2 and the clipping direction is perpendicular to the outer surface of the holster pocket 2. As shown in FIG. 2A of the drawings, if a user is holding on the handgun for pulling out the handgun from the holster pocket 2, an upward pulling force F is applied on the button clip 3. However, the pulling force is along a vertical direction that is perpendicular to the clipping direction of the button clip 3, so that the engaged button clip 3 is not easy to be disengaged.

With referring to FIG. 2B, the conventional belt holster designs often require multiple hand actions or the use of both hands to open the holster pocket 2, which may delay the time to retrieve the handgun in emergency situations. In other words, before retrieving the handgun from the holster pocket 2, the step of undoing buckles will add complexity to the operation. This increases the complexity of operation for users and hinders quick response in emergency situations, and this complexity, especially under high pressure and emergency conditions, can result in user errors or time wastage. Inability to promptly access the handgun leaves the person vulnerable to immediate threats, reducing their ability to defend themselves or others effectively. Without quick access to the handgun, there is a higher risk of injury or harm if the person is unable to deter or neutralize the threat swiftly.

Additionally, current pocket designs often fail to ensure the stability of the handgun. As shown in FIG. 2B, a magazine pocket 4 for receiving a magazine is provided adjacent to the holster pocket 2. When retrieving the handgun from the holster pocket 2, the handgun may come into contact with the magazine during the process of drawing. Therefore, how to improve the speed of retrieving the handgun while ensuring its stability is an urgent problem to be solved in the current technology.

Furthermore, the conventional belt holster may further comprise a plurality of auxiliary pockets 5 fixed to the belt body 1 for storing personal items. However, the fixed auxiliary pockets 5 cannot be adjusted to suit individual preferences or needs. For instance, if a user habitually places his cell phone on the left side of the belt holster when the belt holster is worn on the waist of the user, but the auxiliary pocket 5 is fixed on the right, is will cause inconvenience for the user to reach his cell phone. This inflexibility can be particularly problematic in situations where frequent access to items is crucial.

SUMMARY OF THE PRESENT INVENTION

The invention is advantageous in that it provides a band holster for quick draw, which allows the user to easily retrieve the handgun from the band holster with a single drawing action.

Another advantage of the present invention is to provide a band holster for quick draw, wherein the single drawing operation of a hand of the user will achieve both the undoing of a clasp means and the retrieval of the handgun in one smooth motion. This streamlined process enhances efficiency and reduces response time, making it ideal for emergency situations.

Another advantage of the present invention is to provide a band holster for quick draw which simplifies the operation. The unique pouch design of the present invention places the clasping position of the clasp means to be adjacent to a top opening of the handgun pouch, allowing the user to open the pocket while retrieving the handgun with a single hand. This greatly simplifies the process of retrieving the handgun and improves the ability to respond quickly in emergency situations, which is of great significance for self-defense or handling emergencies.

Another advantage of the present invention is to provide a band holster for quick draw, wherein the simplified operation of the present invention enhances the user's ability to respond quickly in emergency situations. With just one single drawing operation by a single hand, the user can open the pouch and retrieve the handgun seamlessly, minimizing response time and improving overall readiness for emergent situations, where every second and movement count. This advantage highlights the practical significance of the present invention in optimizing the speed and efficiency of handgun retrieval, especially when compared to conventional belt holsters.

Another advantage of the present invention is to provide a band holster for quick draw, wherein the pouch design of the present invention can ensure the stability of the handgun during retrieval movement, avoiding contact with other accessories such as magazines when the handgun is taken out of the pouch. Accordingly, a smooth and efficient extraction of the firearm is allowed and the ability to retrieve the handgun smoothly and without interference from other accessories improves the user's overall readiness and confidence in handling critical situations.

Another advantage of the present invention is to provide a band holster for quick draw, wherein the magazine pouch accommodates the magazine at an inclined angle, thus spacing the magazine from the handgun to avoid interference when drawing the handgun. In other words, by creating sufficient space between the magazine and the handgun, smooth and unobstructed access to the handgun during retrieval is ensured, so as to significantly improves the overall functionality and practicality of the band holster, and enhance the user's ability to respond swiftly in emergency situations.

Another advantage of the present invention is to provide a band holster for quick draw, wherein the pouch design allows the handgun to be securely stored when not in use. Accordingly, by incorporating the feature of the secure buckling mechanisms, the band holster ensures that the handgun is securely stored and remains in position until intentionally drawn by the user. The handgun can remain firmly and safely in place, even during movement or strenuous activities Another advantage of the present invention is to provide a band holster for quick draw, wherein one or more utility pouches can be detachably adhered to the band body, making it convenient for the user to fix the items on the desired position on the band body. The ability to detachably bond the utility pouches to the band body enhances versatility and customization options. The user can easily attach or detach pouches as needed, accommodating various items such as additional magazines, flashlights, multitools, keys and phones.

Another advantage of the present invention is to provide a band holster for quick draw, wherein the utility pouches have elastic structures to adapt to different widths and lengths of items such as phones and magazines, allowing the user to easily adjust the utility pouches to fit specific items according to his or her preferences. This customization adds flexibility to the band holster, so that the user can organize his or her personal items efficiently and reliably.

Another advantage of the present invention is to provide a band holster for quick draw, wherein the adhesive layer used to adhere the utility pouches is not easily sticky to the fur on clothes, thus maintaining its neatness without damaging the clothing.

Additional advantages and features of the invention will become apparent from the description which follows, and may be realized by means of the instrumentalities and combinations particularly pointing out in the appended claims.

According to the present invention, the foregoing and other objects and advantages are attained by a band holster for quick draw, comprising:

a band body;

a handgun pouch connected to the band body, wherein the handgun pouch has an accommodating compartment for holding a handgun; and a clasp means which is capable of being operated between a closed state for retaining the handgun at the handgun pouch and an open state for allowing the handgun to be retrieved from the handgun pouch.

According to an embodiment, the clasp means is coupled to the handgun pouch and is configured to allow a single drawing operation of a single hand of the user to release the clasp means and retrieve the handgun from the handgun pouch.

According to an embodiment, the handgun pouch comprises an inner layer connected to the band body, and an outer layer connected to the inner layer to define the accommodating compartment with a top opening communicated to the accommodating compartment, wherein the clasp means comprises a first connecting strap connected to the inner layer of the handgun pouch, a second connecting strap connected to the outer layer of the handgun pouch, and a clasp assembly which comprises a first clasp element connected to the first connecting strap, and a second clasp element connected to the second connecting strap, wherein the first clasp element is detachably coupled with the second clasp element for retaining the handgun at the accommodating compartment in the closed state and allows the handgun to be retrieved out through the top opening of the handgun pouch by the single drawing operation.

According to an embodiment, the clasp assembly is configured in a manner that the first clasp element is capable of being detachably coupled with the second clasp element to define a clasping position which is above the top opening of the handgun pouch.

According to an embodiment, the clasp assembly is a VELCRO™ means.

According to an embodiment, the clasp assembly is a pair of a button and a buttonhole member.

According to an embodiment, the first clasp element is a button which is mounted to an upper free end portion of the first connecting strap, wherein the second clasp element is a buttonhole member which is mounted to an upper free end portion of the second connecting strap.

According to an embodiment, the first clasp element is a buttonhole member which is mounted to an upper free end portion of the first connecting strap, wherein the second clasp element is a button which is mounted to an upper free end portion of the second connecting strap.

According to an embodiment, when the clasp assembly is in the closed state for retaining the handgun at the accommodating compartment, a gap is defined between the upper free end portion of the first connecting strap and the upper free end portion of the second connecting strap, so as to allow a thumb of the hand of the user to slide into the gap to cause the clasp assembly to be released during the single drawing operation.

According to an embodiment, the clasp assembly defines a clasping position in the closed state which is configured to allow a thumb of the hand of the user to slide along an inner side of the band body to apply a toggle force to the clasping position to cause the clasp assembly to be released during the single drawing operation.

According to an embodiment, the second connecting strap is an elastic strap, wherein the first connecting strap is in an upright state when the clasp assembly is in the open state.

According to an embodiment, the first connecting strap is mounted to an inner surface of the inner layer of the handgun pouch, wherein the second connecting strap is mounted to an outer side of the outer layer of the handgun pouch.

According to an embodiment, the button comprises a button seat which is embedded into the upper free end portion of the first connecting strap, and a button pin which is protruded from the button seat, wherein the button pin comprises an enlarged head portion and a circular clasping groove adjacent to the enlarged head portion, wherein the buttonhole member comprises a mounting strap which is folded to provide two strap layers which are clamping the upper free end portion of the first connecting strap to form a sandwich structure, a base plate attached to one of the strap layers, and a retention component attached to the other strap layer, wherein the retention component has a retention hole for engaging with the button pin and has an access opening which is communicated to the retention hole, wherein two retention pins are mounted in the access opening and are spaced apart from each other to allow the enlarged head portion of the button pin to be squeezed into the retention hole until the two retention pins are engaged with the circular clasping groove.

According to an embodiment, the button is mounted to an inner side of the upper free end portion of the first connecting strap.

According to an embodiment, the button is mounted to an outer side of the upper free end portion of the first connecting strap, wherein the clasp assembly defines a clasping position in the closed state which is configured to allow a thumb of the hand of the user to slide along the second connecting strap to release the clasp assembly during the single drawing operation.

According to an embodiment, the band holster further comprises a pouch assembly which comprises an inner sheet and an outer sheet which are connected with each other to define the handgun pouch and one or more magazine pouches, wherein each of the one or more magazine pouches has an inclined magazine compartment so as to inclinedly storing the magazine, so as to allow the handgun to be spaced apart from the magazine.

According to an embodiment, the band holster further comprises one or more utility pouches, wherein each of the one or more utility pouches comprises an attaching layer for detachably coupling with the band body, a holding layer connected to the attaching layer to define a holding compartment for receiving a personal item, and a connecting belt for retaining the personal item in the holding compartment.

According to an embodiment, the band holster further comprises the connecting belt is an elastic belt that is stretchable, wherein two ends of the connecting belt are respectively detachably connected to the attaching layer and the holding layer According to an embodiment, the attaching layer comprises an installing loop layer facing the holding layer, and the utility pouch further comprises a mounting loop layer formed on the holding layer, the connecting belt comprises two end hook layers attached to the two end portions of the connecting belt at two opposite sides of the connecting belt so as to detachably coupling with the installing loop layer and the mounting loop layer.

According to an embodiment, the band body comprises a base layer, and a connecting means for detachably connecting two end portions of the band body, so as to allow the band body to form a circular belt that can be worn on the waist of the user.

According to an embodiment, the connecting means can be magnetically coupling means, VELCRO™ Means, snap fasteners, screw fasteners, hook-and-eye fasteners, clip fasteners, buckle fasteners or screw fasteners.

According to an embodiment, the connecting means is embodied as a VELCRO™ means which comprises a loop layer formed on an outer side of the base layer, and a hook layer connected to an end of the the base layer at an inner side of the base layer for detachably coupling with the loop layer.

According to an embodiment, the band body further comprises an edge wrapping layer which is wrapped on peripheral surrounding edges of the base layer and the connecting means.

According to an embodiment, the edge wrapping layer is fixed and wrapped on edges of said pouch assembly.

According to an embodiment, the band holster for quick handgun retrieval of the present invention comprises a band body, a handgun storage pouch fixed on the band body, and a detachable mobile phone case and accessory case installed on the belt body. The handgun storage pouch is used to store the handgun, the mobile phone case can store a mobile phone or other electronic devices or items, and the accessory case can be used to store handgun accessories such as magazines.

According to an embodiment, the handgun storage pouch comprises an inner layer and an outer layer, forming a storage space for the handgun inside. The inner layer is connected with a first connecting strap, and the outer layer is connected with a second connecting strap. The first and second locking elements that can be mutually fixed and detached are respectively provided on the first connecting strap and the second connecting strap, and can be bonding elements such as matching hook-and-loop elements. In the illustrated drawings, they are represented as matching button components.

According to an embodiment, unlike the prior art in FIGS. 1 to 2B, the two locking elements of the present invention are not positioned on the outer side of the outer layer of the handgun storage pouch when they are connected and fixed, but are adjacent to the inner layer of the handgun storage pouch, and preferably, their connection position is above the storage space for the handgun. In this way, when the user pulls out the handgun from the handgun storage pouch with a single hand, the two locking elements will also be unlocked, making it convenient to retrieve the handgun quickly. In other words, the user does not need to perform additional operations to unlock the two locking elements.

According to an embodiment, the first connecting strap connected to the inner layer of the handgun storage pouch is relatively hard, and the second connecting strap connected to the outer layer is relatively soft and elastic, so that when the handgun is stored, the second connecting strap can be stretched, so as to facilitate the handgun to be tightly fastened in the handgun pocket through the second two connecting strap.

According to an embodiment, when the user pulls the handgun out of the holster with one hand, the upward pulling force along the first connecting strap causes the one of the first connecting strap and the second second strap to bend, thereby generating a force acting on the first locking element and the second locking element, making it easier to overcome the locking force between the first locking element and the second locking element and achieve quick unlocking between them.

According to an embodiment, on both sides of the handgun pocket, there are respective magazine compartments. In the present invention, the boundary lines on both sides of the magazine compartments are inclined, so that the magazines can be stored in an inclined manner. This allows for a gap between the magazine and the handgun when they are in a stored state, thus avoiding contact between the handgun and the magazine when retrieving the handgun.

According to an embodiment, the phone case and magazine case can be detachably attached to the band body, making it convenient for the user to adjust the orientation of the accessory case, so as to fix it in the suitable position on the band body according to the user's desired posture. In addition, the phone case and magazine case have elastic structures to adapt to different widths and lengths of phones and magazines. Specifically, the fastening belt can elastically extend, so that the phone case and magazine case can respectively tighten phones and magazines of different lengths. Furthermore, the main body of the phone case and magazine case is also an elastic structure, which respectively facilitates accommodating phones and magazines of different widths and thicknesses.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
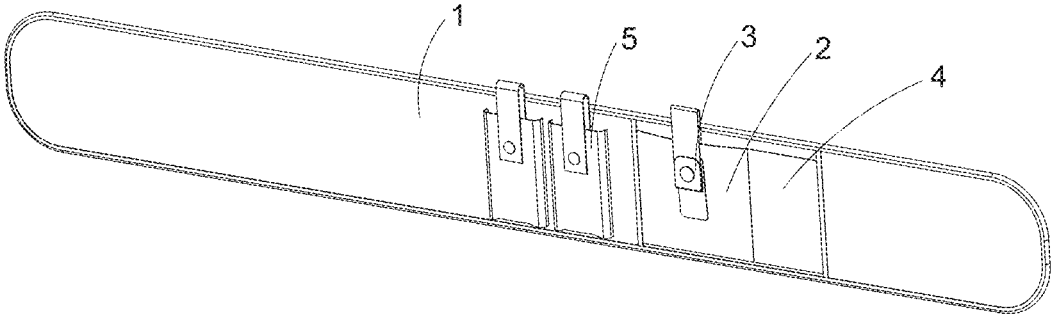
PRIOR ART Fig.1
FIG. 1 is a perspective view of a conventional belt holster.
Figure 2A:
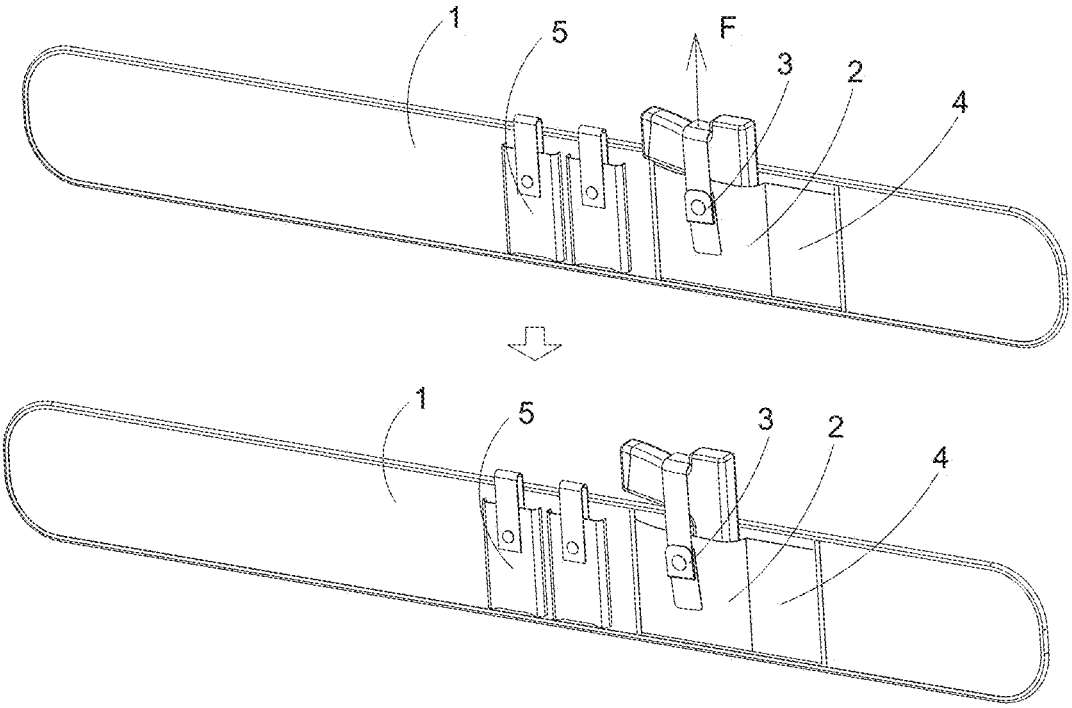
PRIOR ART Fig.2A
FIG. 2A is a schematic view illustrating that a single drawing operation will not able to retrieve the handgun from the conventional belt holster.
Figure 2B:
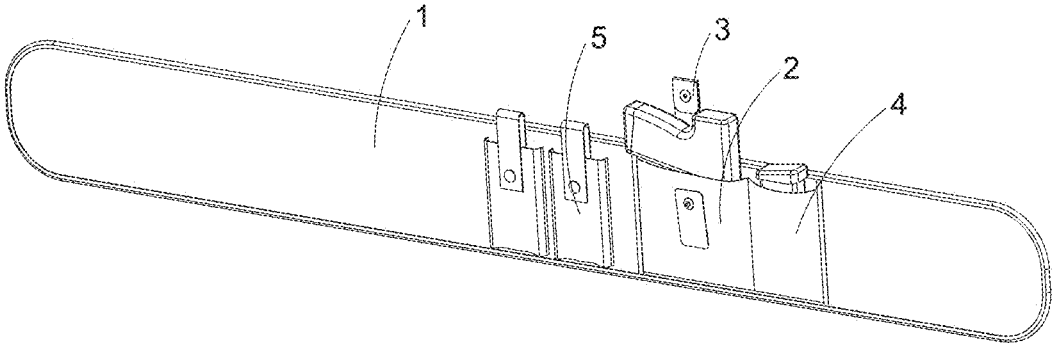
PRIOR ART Fig.2B
FIG. 2B is a perspective view illustrating that an operation of undoing the buckle is required before the user is able to retrieve the handgun from the conventional belt holster.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Those skilled in the art should understand that, in the disclosure of the present invention, terminologies of "longitudinal," "lateral," "upper," "front," "back," "left," "right," "perpendicular," "horizontal," "top," "bottom," "inner," "outer," and etc. that indicate relations of directions or positions are based on the relations of directions or positions shown in the appended drawings, which are only to facilitate descriptions of the present invention and to simplify the descriptions, rather than to indicate or imply that the referred device or element is limited to the specific direction or to be operated or configured in the specific direction. Therefore, the above-mentioned terminologies shall not be interpreted as confine to the present invention.

Referring to FIG. 3 to FIG. 24 of the drawings, a band holster 100 for quick draw according to a preferred embodiment of the present invention is illustrated. The band holster 100 comprises an elongated band body 10 adapted for being worn on a user such as a waist of the user, a pouch assembly 20 for holding and storing a handgun 200, and a clasp means 30 coupled to the pouch assembly 20 for detachably and securely retaining the handgun 200 within the pouch assembly 20.

The band body 10 is designed ergonomically to be worn comfortably around the waist of the user, providing a secure and stable platform for supporting the pouch assembly 20 which is designed for carrying the handgun 200. Preferably, the pouch assembly 20 can be provided at a central part of the band body 10 and is responsible for receiving and securely holding the handgun 200. The clasp means 30 plays a crucial role in securely retaining the handgun 200 within the pouch assembly 20, and it could be a quick-release closure mechanism for rapid access to the firearm during emergencies while still providing a secure hold under normal conditions.

In the present invention, a side of the band holster 100, which is adjacent to and facing towards the waist of the user when the band holster 100 is worn on the waist of the user, is described as an inner side of the band holster 100, and the opposite side is described as an outer side of the band holster 100.

More specifically, the band body 10 comprises a base layer 11, and a connecting means 12 for detachably connecting two end portions of the band body 10, so as to allow the band body 11 to form a circular belt that can be worn on the waist of the user. The connecting means 12 can be any suitable detachably coupling means such as magnetically coupling means, VELCRO™ Means, snap fasteners, screw fasteners, hook-and-eye fasteners, clip fasteners, buckle fasteners and screw fasteners.

In this embodiment, as a specific example, the connecting means 12 is embodied as a VELCRO™ means which comprises a loop layer 121 formed on the base layer 11, and a hook layer 122 connected to the base layer 11 for detachably coupling with the loop layer 121. The loop layer 121 of the VELCRO™ means is formed with soft, fibrous loops. The hook layer 122 of the VELCRO™ means is characterized by tiny, stiff hooks that protrude from its base surface, and these hooks are designed to engage with the softer loops on the loop layer 121. When the hook layer 122 is pressed against to the loop layer 121, the loops of the loop layer 121 interlock with the hooks of the hook layer 122, creating a secure fastening.

Figure 3A:
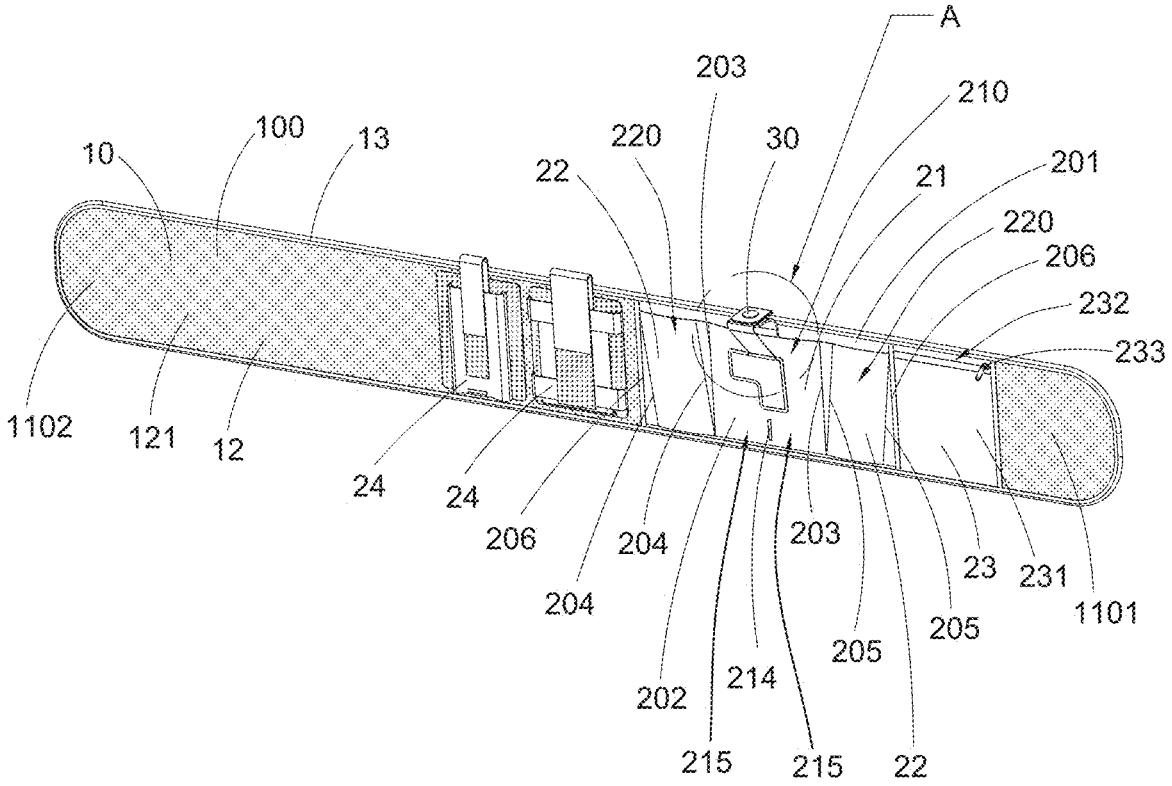
FIG. 3A is perspective view of a band holster according to a preferred embodiment of the present invention.
Figure 3B:
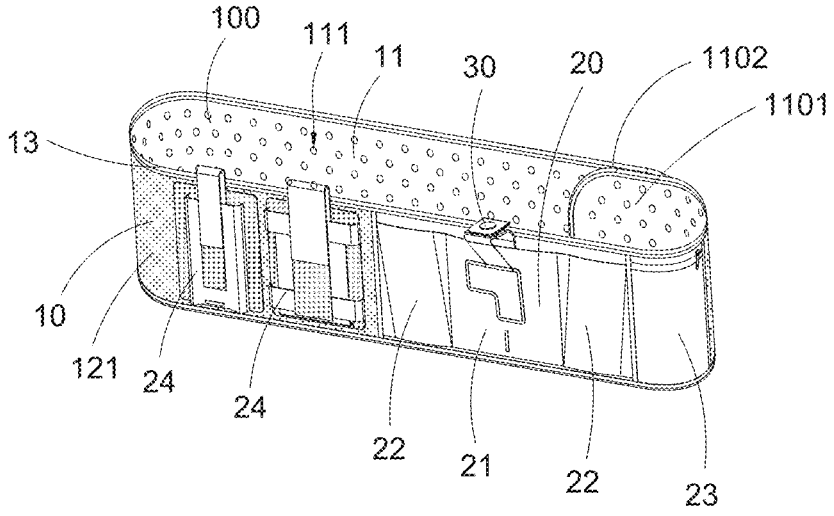
FIG. 3B is a perspective view of a band holster being in a circular closure structure according to the above preferred embodiment of the present invention.

As shown in FIG. 3A of the drawings, in this embodiment, the loop layer 121 is extended along a length of the base layer 11 and is formed at an outer side of the base layer 11, the hook layer 122 is provided at an inner side of the base layer 11 at a first end portion 1101 of the base layer 11. Accordingly, the loop layer 121 and the hook layer 122 are provided at two opposite sides of the base layer 11, when the band holster 100 is worn on the user, the hook layer 122 is facing toward the body of the user, and the loop layer 121 is prevented from having contact with the body of the user. The hook layer 122 at the first end portion 1101 of the base layer 11 is detachably coupled with the loop layer 121 at a second end portion 1102 of the base layer 11, so as to form an end-to-end connecting structure that allows the band holster 100 to form a circular closure belt, as shown in FIG. 3B.

Since the loop layer 121 is extended along the length of the base layer 11, the attaching area of the loop layer 121 for bonding with the hook layer 122 can be adjusted, so as to adjust the diameter of the circular closure belt formed by the band holster 100, so that the band holster 100 can accommodate users with varying waist sizes. In addition, the surface which may be adjacent to or be contacting with the body of the user is the base layer 11, rather than the loop layer 121, so that a more smooth layer is provided at the inner side of the band holster 100 when the band holster 100 is worn on the waist of the user.

The band body 10 further comprises an edge wrapping layer 13 which is wrapped on peripheral surrounding edges of the base layer 11 and the connecting means 12, so as to enhance the aesthetic appearance of the band body 10 and also prevent the loops or hooks of the connecting means 12 to have contact with the human body. Preferably, the edge wrapping layer 13 comprises two layers which are respectively sewed to the upper and lower surfaces of the edges of the base layer 11 and the connecting means 12.

The base layer 11 can be any soft and flexible material, such as spandex, nylon, polyester, Polyvinyl Chloride, and fabric. Alternatively, two or more materials can be used to form the base layer 11, such a combination of spandex and nylon, a combination of nylon and polyester, and a combination of spandex and polyester, and in the combination, an appropriate additive such as an amount of chloroprene rubber can be added to the composite material to enhance the tensile strength and tear resistance, so as to improve the reliability and durability of the composite material.

The loop layer 121 is generally made of polyester material, and the hook layer 122 is made of nylon material. The edge wrapping layer 13 can be made of soft and flexible material, such as spandex, nylon, polyester, Polyvinyl Chloride, and fabric.

Figure 8:
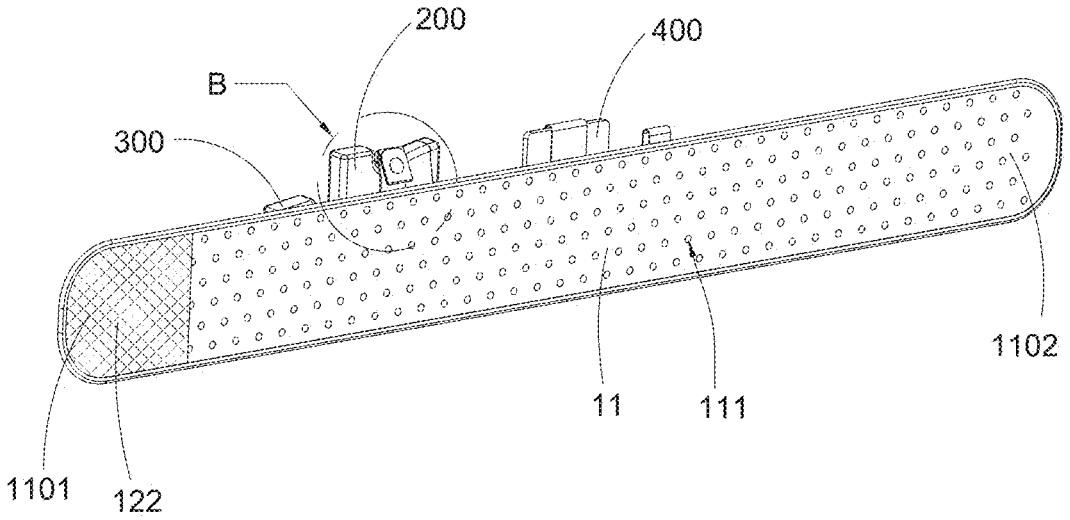
FIG. 8 is a perspective view illustrating an inner side of the band holster according to the above preferred embodiment of the present invention.

Furthermore, As shown in FIG. 3B and FIG. 8 of the drawings, the base layer 11 has a plurality of holes 111 which is arranged in an array along the entire area of the base layer 11, rendering the base layer 11 an excellent breathability.

In this embodiment, the pouch assembly 20 comprises a handgun pouch 21 fixed to the band body 10 for storing the handgun 200 which can be but not limited to Glock, M&P Shield, Smith and Wesson, Sig Sauer, Springfield, Bodyguard, Ruger, Walthe, Kimber, Rock Island, Bersa, Beretta, and Kahr.

The pouch assembly 20 comprises an elongated inner sheet 201 fixed to the band body 10 and an elongated outer sheet 202 connected to the inner sheet 201 to form the handgun pouch 21 having an accommodating compartment 210 for storing the handgun 200. The inner sheet 201 is covered on the loop layer 121 of the band body 10, so as to avoid the handgun 200 to have frictional contact with the loop layer 121 of the band body 10.

Correspondingly, the handgun pouch 21 comprises an inner layer 211 formed by the inner sheet 201 and is fixed to the band body 10, and an outer layer 212 formed by the outer sheet 202 and is connected to the inner layer 211, the accommodating compartment 210 is defined between the inner layer 211 and the outer layer 212. The inner layer 211, which has an area larger than the outer layer 212, comprises an upper edge 2111, a lower edge 2112, and a body layer 2113 between the upper edge 2111 and the lower edge 2112, the upper edge 2111 and the lower edge 2112 are both wrapped and covered by the edge wrapping layer 13, and the body layer 2113 is covered on the loop layer 121 of the band body 10.

A top opening 213 is formed between the inner layer 211 and the outer layer 212 for communicating with the accommodating compartment 210, so that the handgun 200 is accessible to the accommodating compartment 210 through the top opening 213. The lower portions of the inner layer 211 and the outer layer 212 are connected to prevent the handgun 200 from exiting the accommodating compartment 210.

The bottom of the accommodating compartment 210 may be sealed, so that the handgun pouch 21 can be formed with a sealing lower end portion. In this embodiment, the handgun pouch 21 comprises a connecting seam 214 which connect the lower portions of the inner layer 211 and the outer layer 212, so as to prevent the handgun 200 to slip off from the bottom of the accommodating compartment 210. The connecting seam 214 can be a glue layer applied between the lower portions of the inner layer 211 and the outer layer 212, or is a stitching line connecting the lower portions of the inner layer 211 and the outer layer 212.

Figure 6:
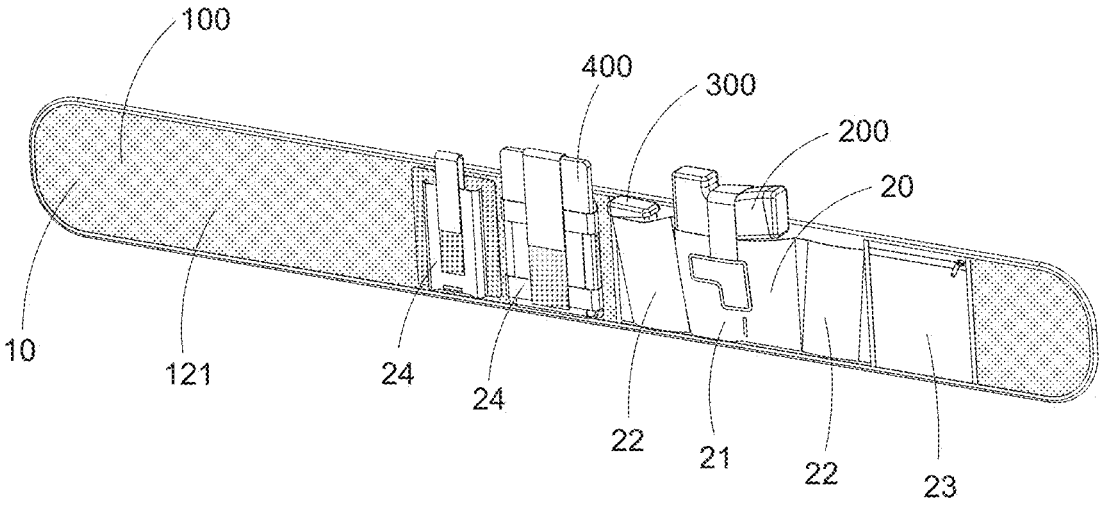
FIG. 6 is a perspective view of the band holster which is adapted for right hand drawing according to the above preferred embodiment of the present invention.
Figure 7:
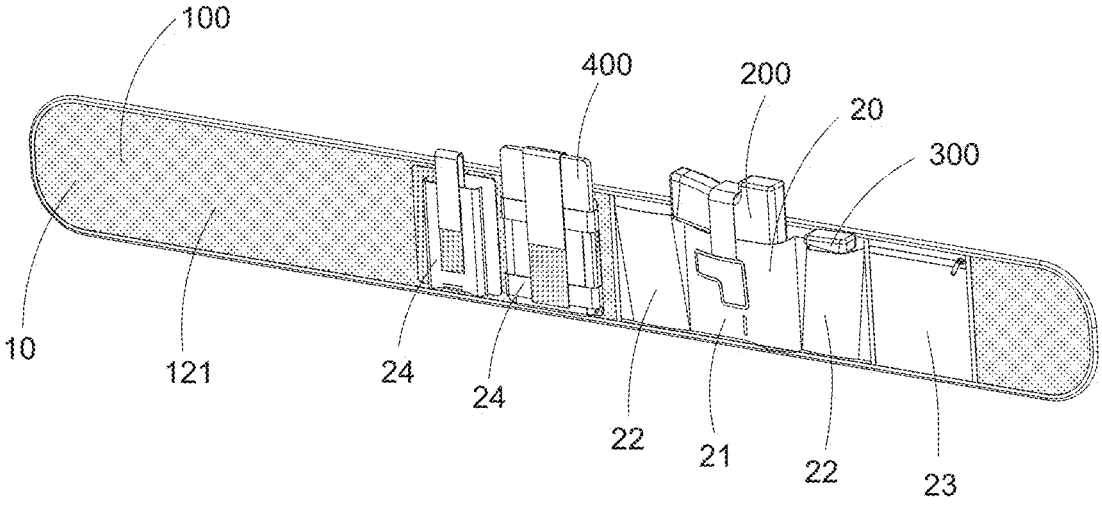
FIG. 7 is a perspective view of the band holster which is adapted for left hand drawing according to the above preferred embodiment of the present invention.

The connecting seam 214 can be formed at a middle of the lower portion of the handgun pouch 21, and two bottom holes 215 are formed at the two opposite sides of the connecting seam 214. The handgun 200 generally comprises a grip portion and a barrel portion, and regardless of its orientation, the barrel portion may be retained at one of the two bottom holes 215, so that the handgun 200 can be stored at the handgun pouch 21 for either right hand draw or left hand draw, as shown in FIGS. 6 and 7 of the drawings.

Figure 13:
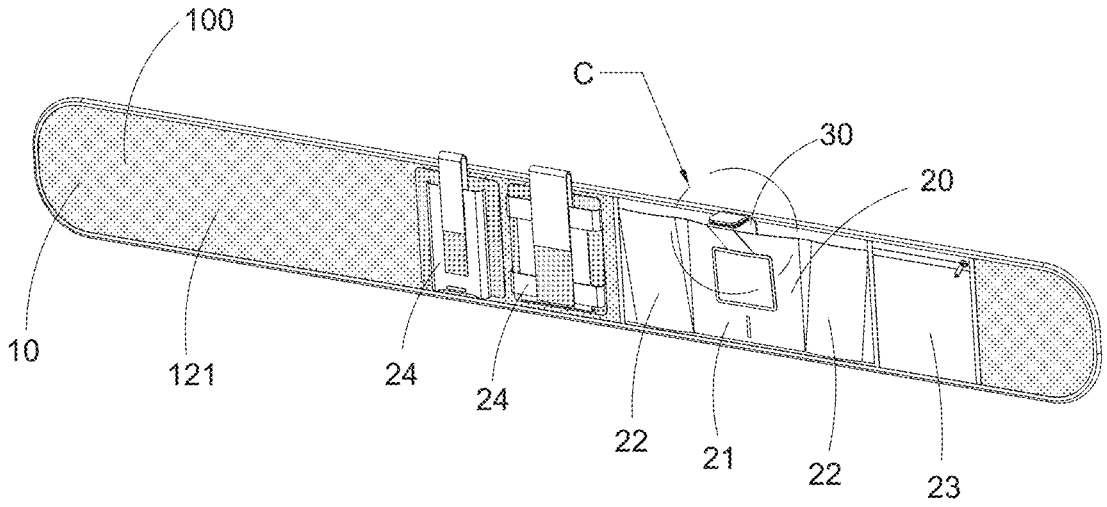
FIG. 13 is a perspective view of band holster according to a second alternative mode of the above preferred embodiment of the present invention.

The clasp means 30 is coupled to the handgun pouch 21 to retain the handgun 200 at the accommodating compartment 210 defined between the inner layer 211 and the outer layer 212, and is able to be moved between a closed state for holding the handgun 200 at the accommodating compartment 210 and an open state in which the handgun 200 is allowed to be retrieved through the accommodating compartment 210. The clasp means 30 can be provided a central area of the handgun pouch 21, so that the band holster 100 can be adapt to both left hand draw and right hand draw. Alternatively, the clasp means 30 can be provided at a position deviated from the central area of the handgun pouch 21, so that the hand holster 100 is design for left hand draw or right hand draw, as shown in FIG. 13.

In this embodiment, the clasp means 30 is configured in a manner that an upward single retrieving operation of a single hand of the user is able to simultaneously unlock the clasp means 30 and retrieve the handgun 200 from the accommodating compartment 210.

More specifically, the clasp means 30 comprises a first connecting strap 31 connected to the inner layer 211 of the handgun pouch 21, a second connecting strap 32 connected to the outer layer 212 of the handgun pouch 21, a clasp assembly 33 for detachably connecting the first connecting strap 31 to the second connecting strap 32. Alternatively, the first connecting strap 31 may be connected to the hand body 10.

The clasp assembly 33 comprises a first clasp element 331 connected to an upper free end portion 3101 of the first connecting strap 31, and a second clasp element 332 connected to an upper free end portion 3201 of the second connecting strap 32, and the first clasp element 331 is detachably engaged with the second clasp element 332, so as to form a closure structure for retaining the handgun 200 at the accommodating compartment 210, and are capable of being detached and disengaged with each other to allow the handgun 200 to be retrieved out through the top opening 213 of the handgun pouch 21.

The clasp assembly 33 can be embodied as any suitable detachable fasteners. In this embodiment, the clasp assembly 33 is embodied as a button assembly. Corresponding, the first clasp element 331 is a button 3310 and the second clasp element 332 is embodied as a buttonhole member 3320 which has a retention hole 3321 for engaging with the button 3310 of the first clasp element 331. Unlike the VELCRO™ fasteners that the bonding ability will be reduced after frequent use, the button assembly is advantageous in that it can be repeatedly used.

Figure 9A:
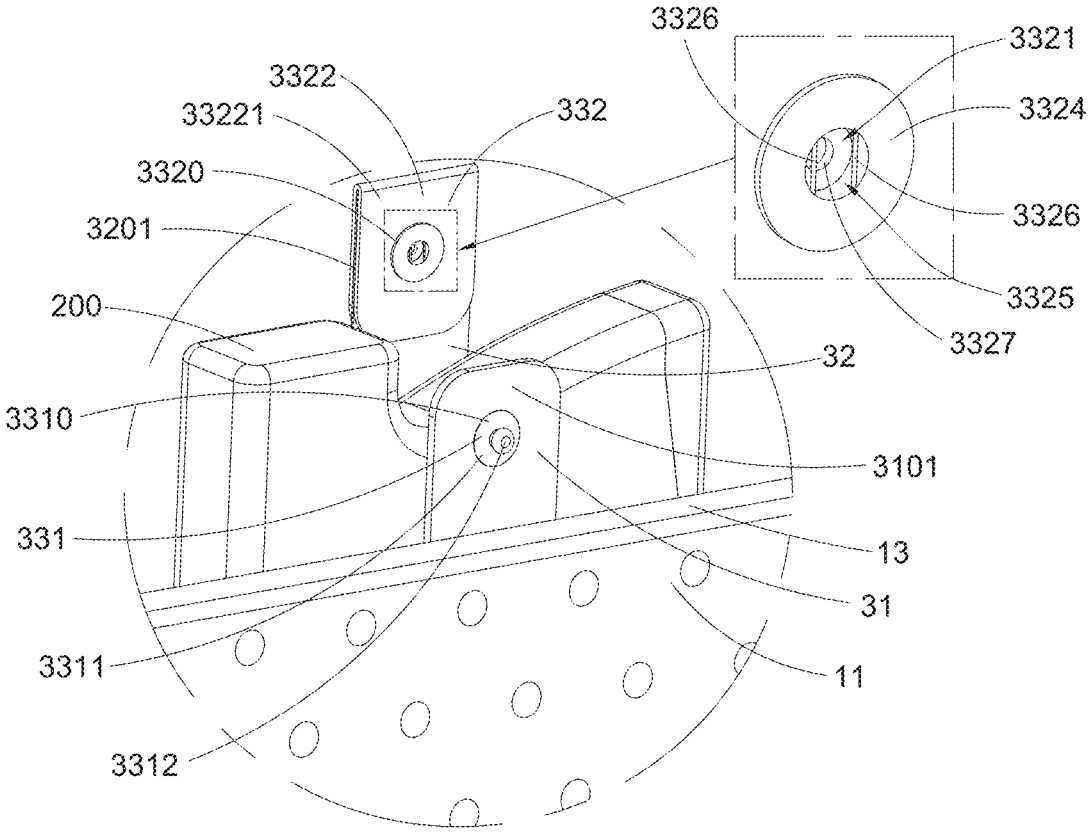
FIG. 9A is a partial enlarged view illustrating a clasp means of the band holster being in an open state according to the above preferred embodiment of the present invention.
Figure 9B:
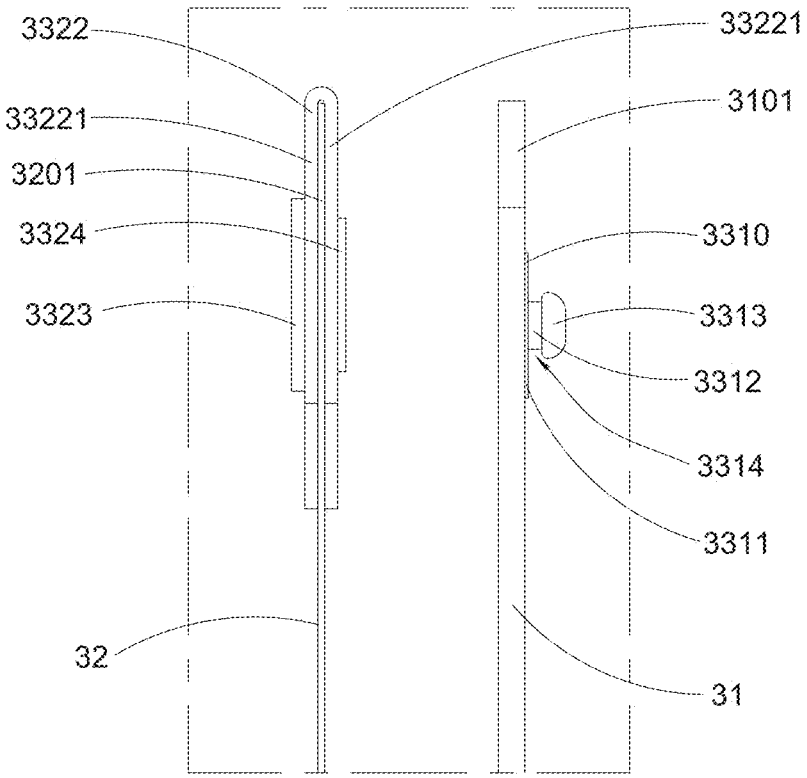
FIG. 9B is a partial side enlarged view illustrating the clasp means of the band holster being in an open state according to the above preferred embodiment of the present invention.

Accordingly, as shown in FIGS. 9A and 9B, the button 3310 comprises a button seat 3311 which is embedded into the upper free end portion 3101 of the first connecting strap 31, and a button pin 3312 which is protruded from the button seat 3311 for engaging with the retention hole 3321 of the buttonhole member 3320. The button pin 3312 comprises an enlarged head portion 3313 and a circular clasping groove 3314 adjacent to the enlarged head portion 3313.

The buttonhole member 3320 comprises a mounting strap 3322 which is folded to provide two strap layers 33221 which are clamping the upper free end portion 3101 of the first connecting strap 31 to form a sandwich structure and enhance the rigidity thereof, a base plate 3323 attached to one of the strap layers 33221, and a retention component 3324 attached to the other strap layer 33221. Accordingly, the base plate 3323 which is round in shape and the retention component 3324 are provided at two opposite sides of the mounting strap 3322, and are firmly mounted with the mounting strap 3322 and the upper free end portion 3101 of the first connecting strap 31. The retention component 3324 defines the retention hole 3321 and has an access opening 3325 which is communicated to the retention hole 3321. The buttonhole member 3320 further comprises two retention pins 3326 mounted in the access opening 3325 and are spaced apart from each other to allow the enlarged head portion 3313 of the button pin 3312 to be squeezed into the retention hole 3321 through the space between the two retention pins 3326 until the two retention pins 3326 are engaged with the circular clasping groove 3314, and the enlarged head portion 3313 of the button pin 3312 is biasing against an abutting ring 3327 in the retention hole 3321, so as to firmly retain the button 3310 with the buttonhole member 3320.

Figure 10:
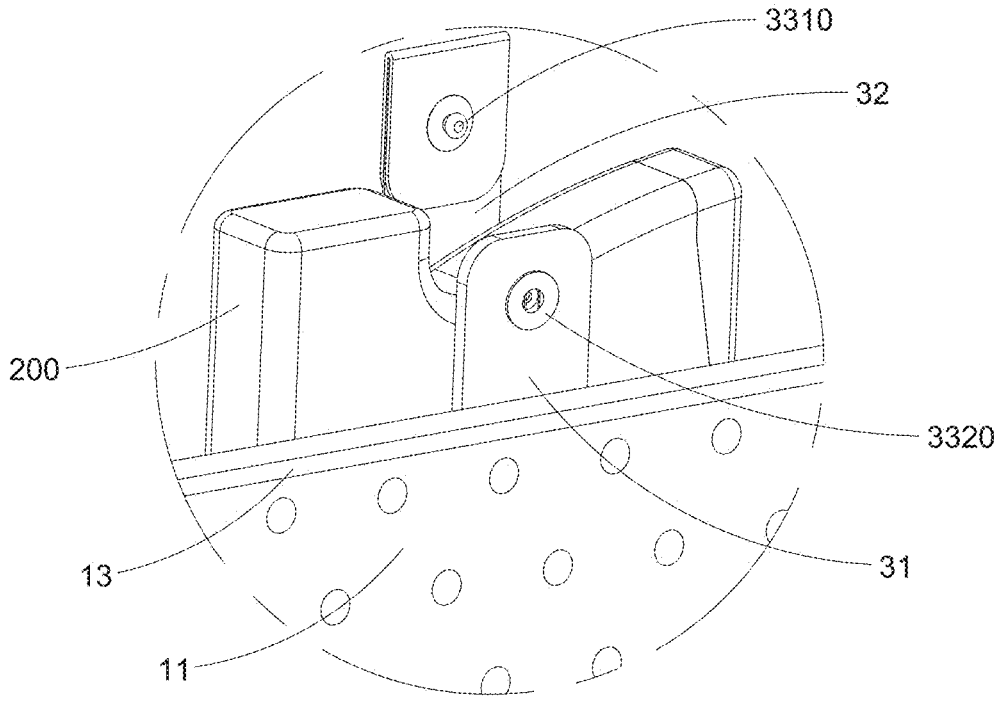
FIG. 10 is a partial enlarged view illustrating a clasp means of the band holster according to a first alternative mode the above preferred embodiment of the present invention.

Alternatively, as shown in FIG. 10, the button 3310 can be formed an an inner side of the upper free end portion 3201 of the second connecting strap 32, and the button hole member 3320 can be formed at the upper free end portion 3101 of the first connecting strap 31.

The first clasp element 331 is engaged with the second clasp element 332 to define a clasping position 330 which is defined above the top opening 213 of the handgun pouch 31, so that when the user retrieve the handgun 200 from the accommodating compartment 210 of the handgun pouch 21, the upward retrieving operation will drive the clasp assembly 33 to be disengaged with each other, or a thumb of the operating hand of the user will drive the first clasp element 331 to be detached from the second clasp element 332, so as to achieve the retrieval of the handgun 200 through a single retrieval operation of the single hand of the user.

Figure 4:
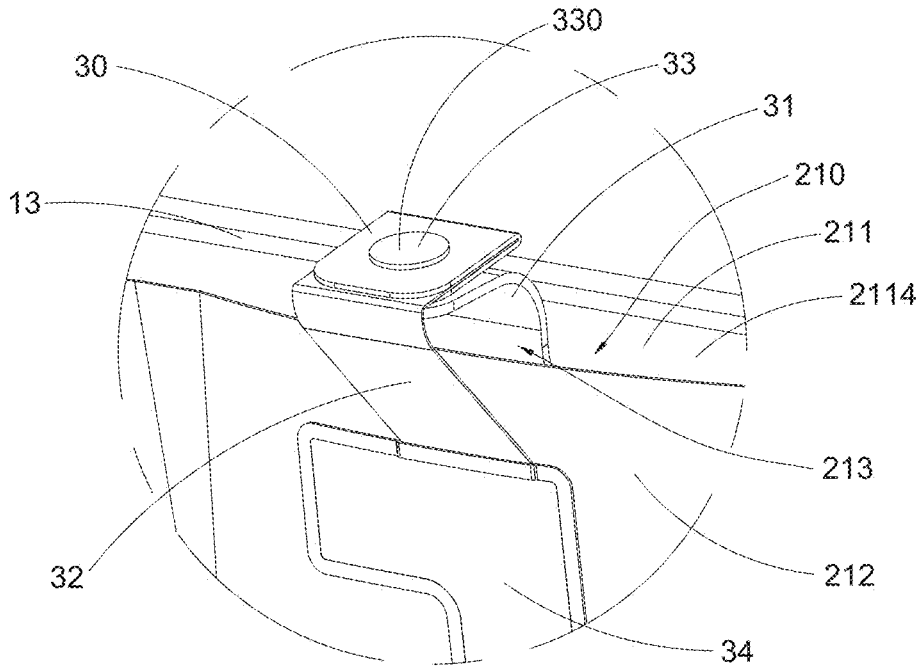
FIG. 4 is a partial enlarged view of area A in FIG. 3A.
Figure 5:
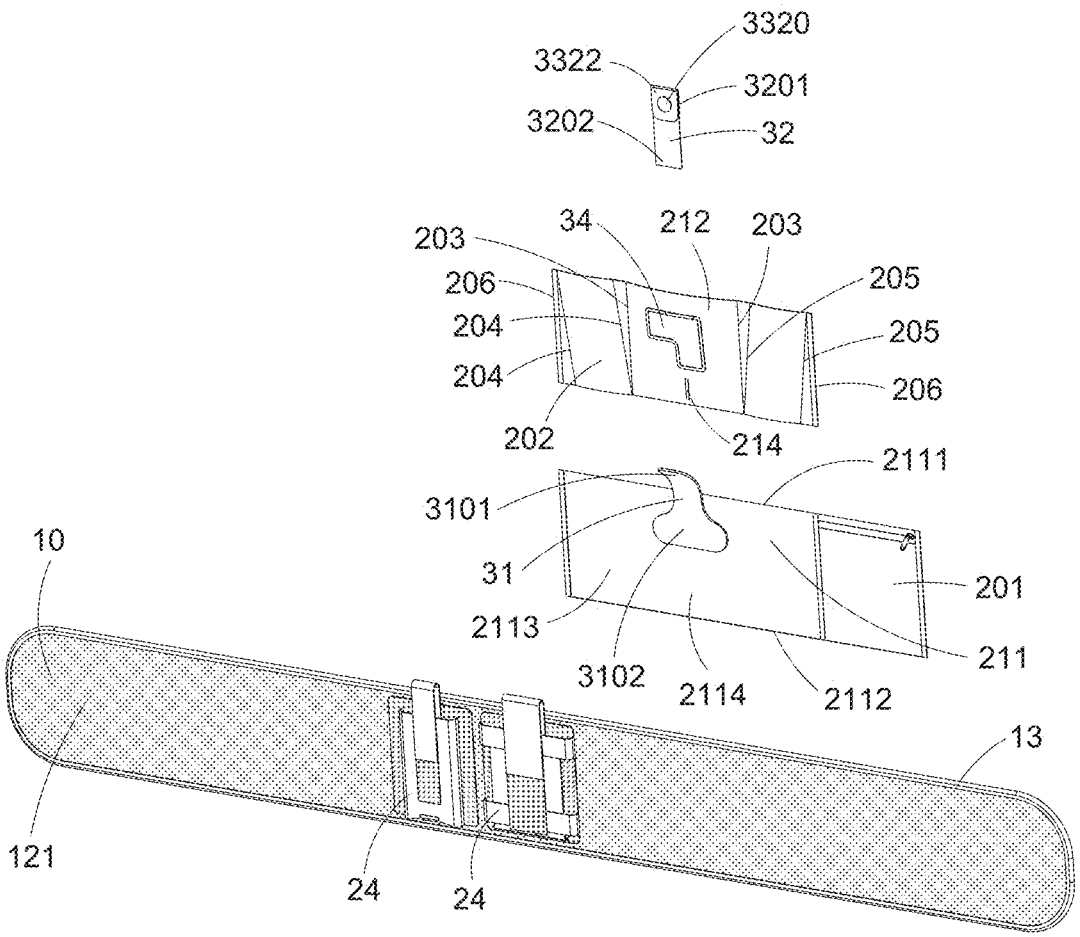
FIG. 5 is an exploded view of the band holster according to the above preferred embodiment of the present invention.

In this embodiment, the clasping position 330 is defined as the engaging position between the button 3310 and the buttonhole member 3320, i.e. the coupling position between the retention hole 3321 and the button pin 3312. As shown in FIG. 4 of the drawings, when the handgun pouch 21 in not stored with the handgun 200, the clasping position 330 is positioned above the top opening 213 of the handgun pouch 21.

In addition, the first connecting strap 31 is more rigid than the second connecting strap 32 which is an elastic elongated strap that is stretchable, so that when the handgun 200 is placed at the accommodating compartment 210 of the handgun pouch 21, the second connecting strap 32 is pulled to be wrapped on the griping portion of the handgun 200, and to align the button 3310 with the buttonhole member 3320.

The first connecting strap 31 can be made of a material such as PVC leather, PU leather, synthetic leather, and plastic-coated fabric. A lower fixing end portion 3102 of the first connecting strap 32 is fixed to an inner surface 2114 of the inner layer 211 of the handgun pouch 21 and is extended into the accommodating compartment 210 of the handgun pouch 21. For example, the lower fixing end portion 3102 of the first connecting strap 32 can be glued or sewn with the inner layer 211 of the handgun pouch 21. In other words, the first connecting strap 31 is preferred to be connected to an inner surface 2114 of the inner layer 211, not the outer surface of the inner layer 211, so as to prevent the first connecting strap 31 to have contact with the human body and just allow the base layer 11 of the band body 10 which provided an integral continual smooth surface which is facing the human body of the user when the band holster 100 is worn on the waist of the user.

Figure 15:
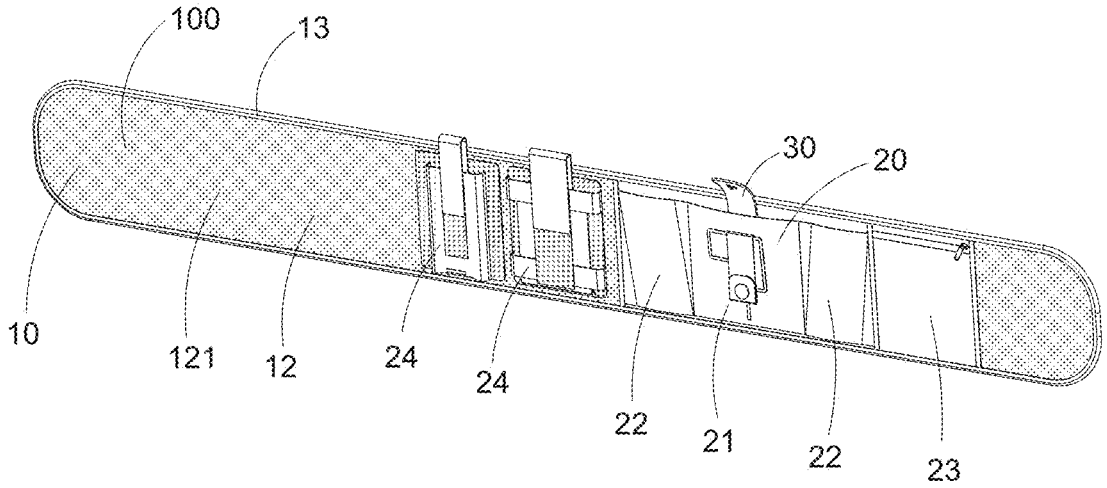
FIG. 15 is a perspective view of band holster according to a third alternative mode of the above preferred embodiment of the present invention.
Figure 16:
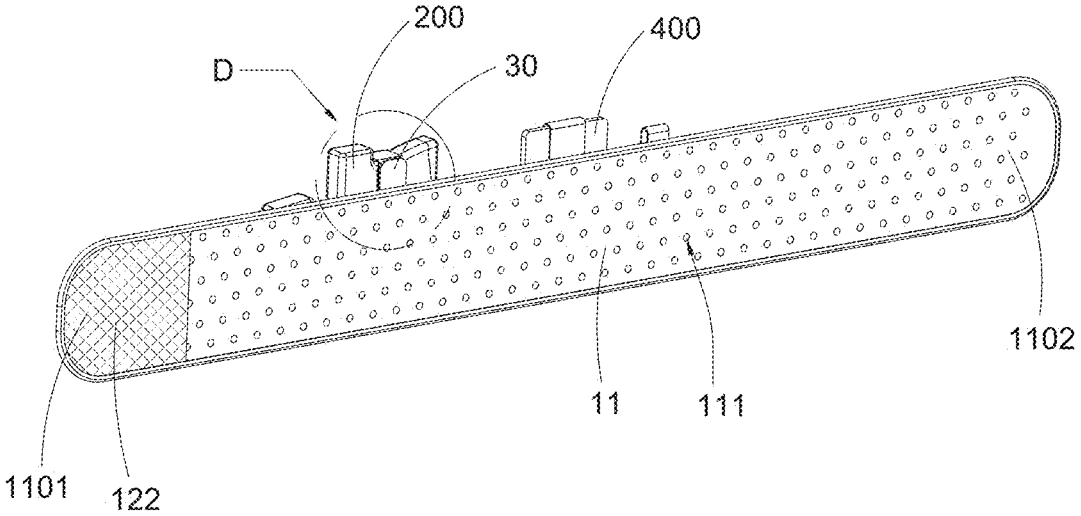
FIG. 16 is a perspective view illustrating an inner side of the band holster according to the third alternative mode of the above preferred embodiment of the present invention.
Figure 21:
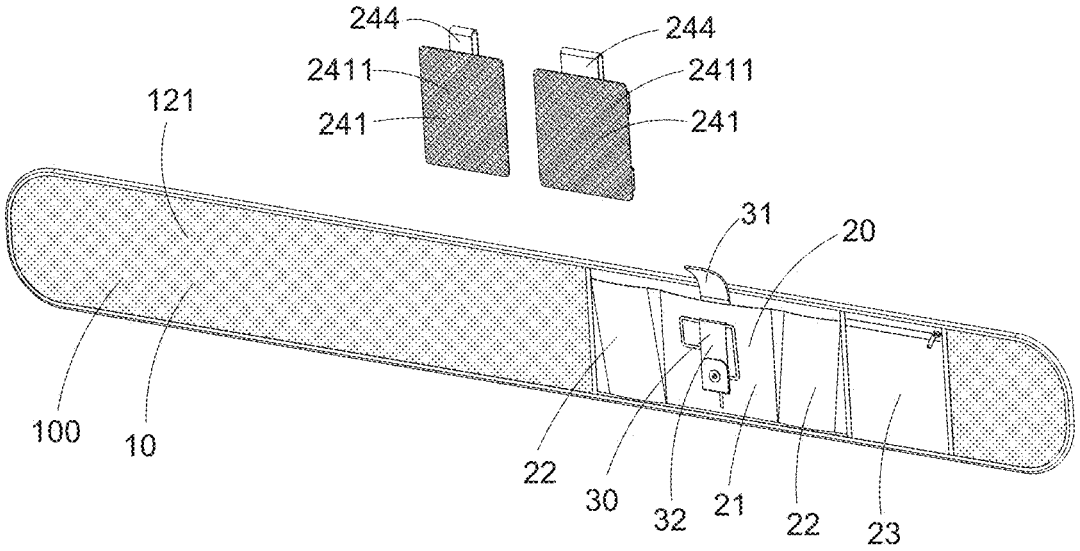
FIG. 21 is a perspective view illustrating a rear side of the utility pouches of the band holster according to the above preferred embodiment of the present invention.

The second connecting strap 32 can be made of elastic material such as polyester, spandex, and rubber material. When the clasping means 30 is in the open state, and the handgun pouch 21 is not placed at the accommodating compartment 210, the first connecting strap 31 is in a upright state without dropping down, and the second connecting strap 32 which has elasticity and stretchability is sagging and drooping down because of gravity, as shown in FIGS. 11D, 15, 21 of the drawings.

Figure 14:
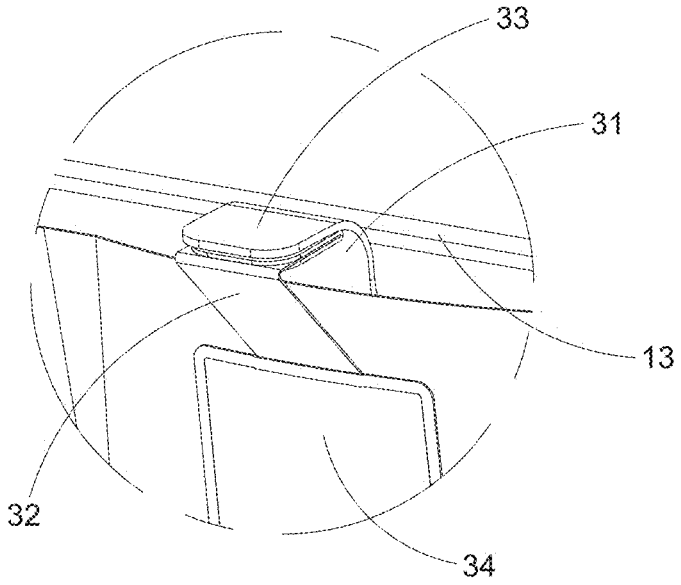
FIG. 14 is a partial enlarged view of area C in FIG. 13.

The clasp assembly 33 further comprises a fixing layer 34 which is used to fix the second connecting strap 32 to the outer layer 212 of the handgun pouch 21. Accordingly, the fixing layer 34 is sewn to the outer layer 212 of the handgun pouch 21 while fixing a lower fixing end portion 3202 of the second connecting strap 32 between the fixing layer 34 and the outer layer 212 of the handgun pouch 21. The fixing layer 34 can be made of a material such as PVC leather, PU leather, synthetic leather, and fabric. In addition, the fixing layer 34 is preferred to be made of rigid leather so that the fixing layer 34 also can be used to protect a trigger of the handgun 200 from accidental contact. A shape of the fixing layer 34 can be an L-shape as shown in FIG. 3A, a square shape as shown in FIGS. 13 and 14 or a rectangular shape, and is not limited.

In the present invention, the single drawing operation of the drawing hand of the user may be embodied as an upward pulling action by the user. In other words, the upward pulling action of the hand of the user can drive the handgun 200 to upward move so as to simultaneously unlock the clasp assembly 33 and retrieve the handgun 200 from the handgun pouch 21.

Alternatively, the single drawing operation of the drawing hand of the user may also include a thumb releasing action which is simultaneously carried out when the drawing hand of the user is pulling the handgun 200 stored at the handgun pouch 21. In other words, a toggling action of the thumb of the drawing hand of the user on one of the connecting straps 31 and 32 can release and unlock the clasp assembly 30.

Figure 11A:
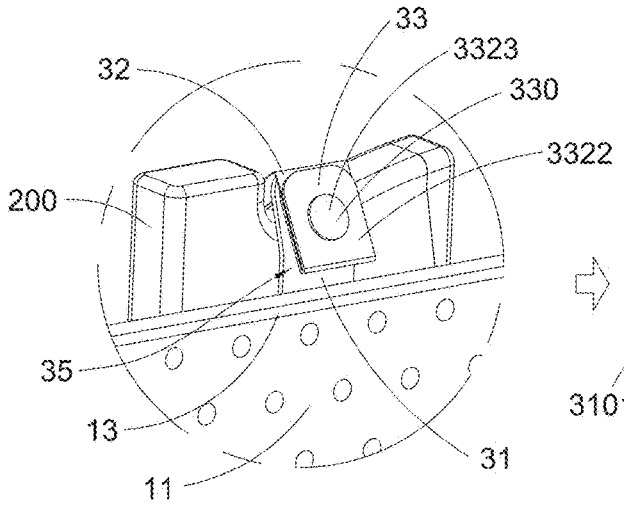
FIGS. 11A, 11B, 11C and 11D are respectively partial enlarged views of area B in FIG. 8 during a single drawing operation for retrieving a handgun from the band holster according to the above preferred embodiment of the present invention.
Figure 11B:
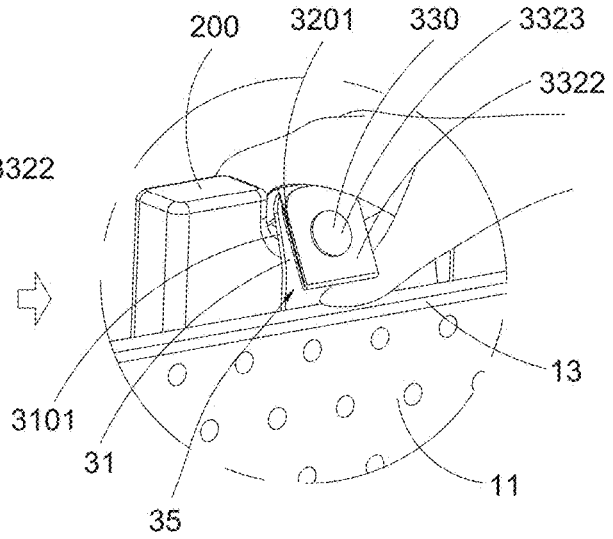
Figure 11D:
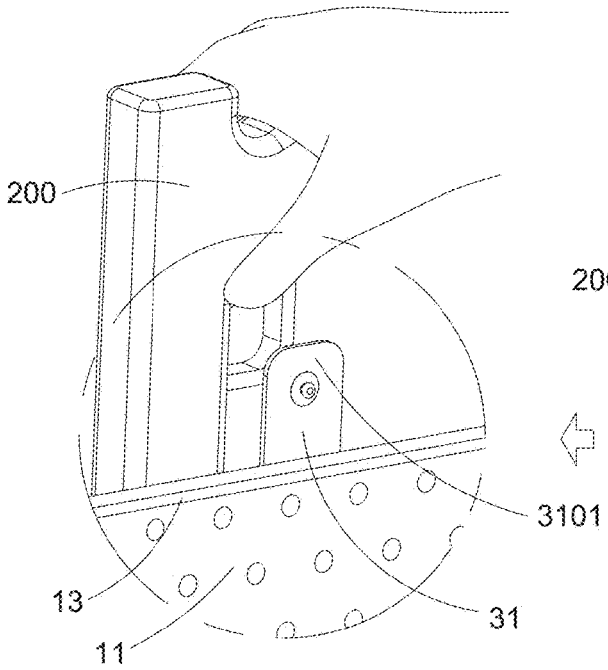

As shown in FIGS. 11A to 11D of the drawings, and also with reference to FIGS. 19A to 19D, the single drawing operation for retrieving the handgun 200 from the handgun pouch 21 of this embodiment is illustrated. Referring to FIG. 11A, when the handgun 200 is placed and stored at the handgun pouch 21, the second connecting strap 32 is pulled so as to allow the mounting strap 3322 to align with the upper free end portion 3101 of the first connecting strap 31, so that the button 3310 on the inner side of the upper free end portion 3101 of the first connecting strap 31 is clasped and engaged with the buttonhole member 3320 on the upper free end portion 3201 of the second connecting strap 32. The elastic second connecting strap 32 is in a tension state and is pulling the upper free end portion 3101 of the first connecting strap 31, and the mounting strap 3322 is tend to be an inclined state, so that a gap 35 is defined between the mounting strap 3322 and the upper free end portion 3101 of the first connecting strap 31.

As shown in FIG. 11B, when the user is using a drawing hand, which is illustrated as a right hand, to retrieve the handgun 200, the thumb is placed at the inner side of the base layer 11 of the band body 10 under the clasp assembly 33 while the rest four fingers are placed at the outer side of the handgun pouch 21. The gripping portion, the upper free end portion 3101 of the first connecting strap 31, the upper fee end portion 3201 of the second connecting strap 32 are in the purlicue area of the drawing hand.

Figure 11C:
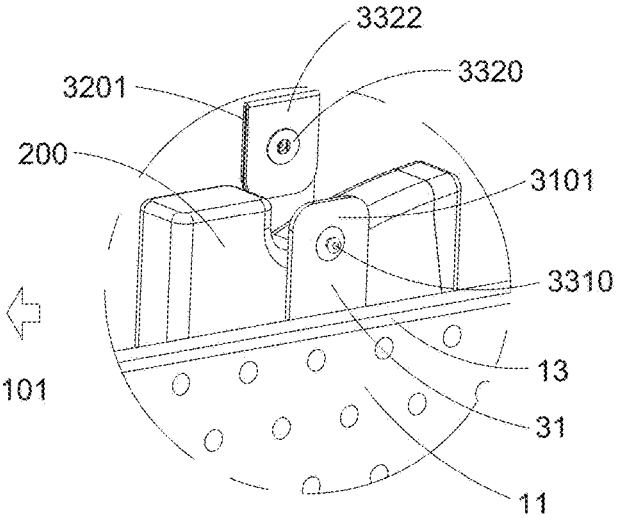
Figure 12A:
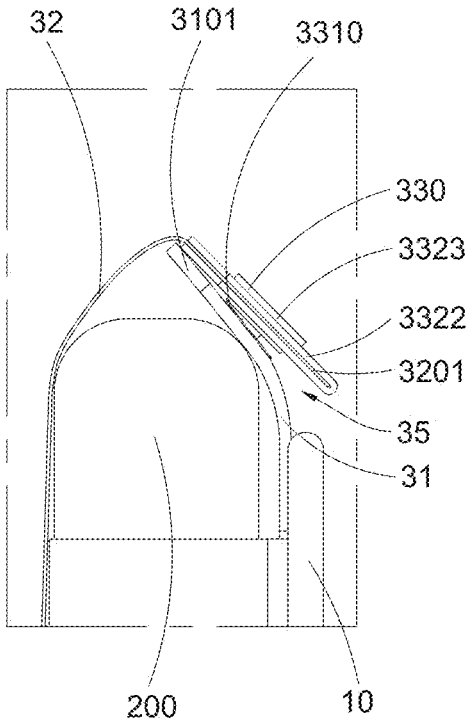
FIGS. 12A, 12B and 12C are respectively side views illustrating the single drawing operation for retrieving the handgun from the band holster according to the above preferred embodiment of the present invention.
Figure 12B:
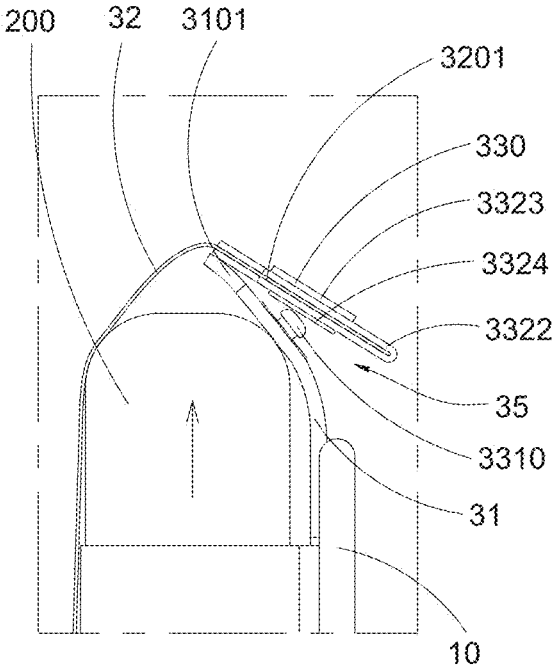
Figure 12C:
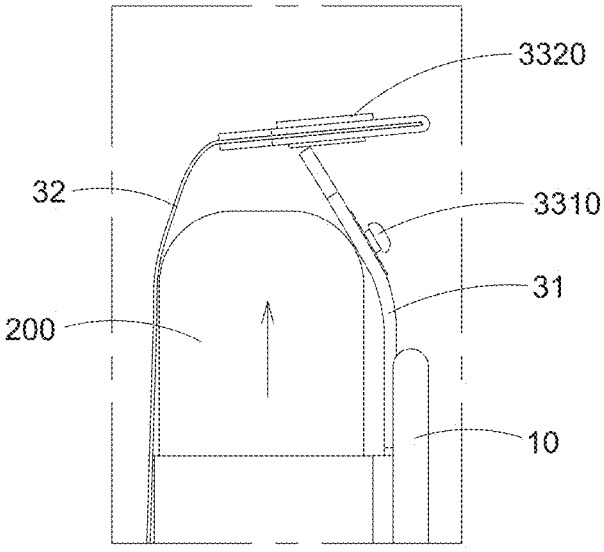

As shown in FIG. 11C, when the user is carrying out the single drawing operation of the single drawing hand, the drawing hand is moving upward to pull the handgun 200 to move upward, and at the same time, the thumb of the drawing hand is sliding along the inner side of the base layer 11 to reach the edge of the mounting strap 3322, and then is sliding into the gap 35 between the mounting strap 3322 and the upper free end portion 3101 of the first connecting strap 31, so that the thumb between the upper free end portion 3101 of the first connecting strap 31 and the upper free end portion 3201 of the second connecting strap 32 is able to apply a toggling force to the mounting strap 3322 to drive the mounting strap 3322 to move, and thus the buttonhole member 3320 is driven to move, so as to be detached from the button 3310, as shown in FIG. 11D, and then the second connecting strap 32 automatically retracts because of its elasticity, and the clasp assembly 33 is thus shifted to the open state to allow the handgun 200 to be quickly and efficiently retrieved from the handgun pouch 21.

Referring to FIGS. 13 and 14 of the drawings, as an alternative mode, the clasp assembly 33 can be embodied as a VELCRO™ means, hook portion and loop portion of the VELCRO™ means are respectively formed on the upper free upper free end portions of the two connecting straps 31 and 32, and the clasping position 330 is defined above the top opening 213 of the handgun pouch 21 in a retrieval moving path of the handgun 200, so that when a single drawing operation is carried out by the user, the upward moving handgun 200 will cause the clasp assembly 33 to be moved from the closed state to the open state for releasing the handgun 200.

Referring to FIGS. 15 to 18, as another alternative mode, the clasp assembly 33 comprises a first clasp element 331 connected to an upper free end portion 3101 of the first connecting strap 31, and a second clasp element 332 connected to an upper free end portion 3201 of the second connecting strap 32, and the first clasp element 331 is detachably engaged with the second clasp element 332, so as to form a closure structure for retaining the handgun 200 at the accommodating compartment 210, and are capable of being detached and disengaged with each other to allow the handgun 200 to be retrieved out through the top opening 213 of the handgun pouch 21.

In this alternative mode, the clasp assembly 33 is embodied as a button assembly. Corresponding, the first clasp element 331 is a button 3310 mounted to an outer surface of an upper free end portion 3101 of the first connecting strap 31 and the second clasp element 332 is embodied as a buttonhole member 3320 mounted to an outer surface of the an upper free end portion 3201 of the second connecting strap 32. Similarly, the button hole member 3320 has a retention hole 3321 for engaging with the button 3310 of the first clasp element 331.

Accordingly, in this embodiment, the clasping position 330 of the clasp assembly 33 formed by the engaging position between the button 3310 and the retention hole 3321 of the buttonhole member 3320 is positioned above the top opening 313 of the handgun pouch 21.

Figure 17A:
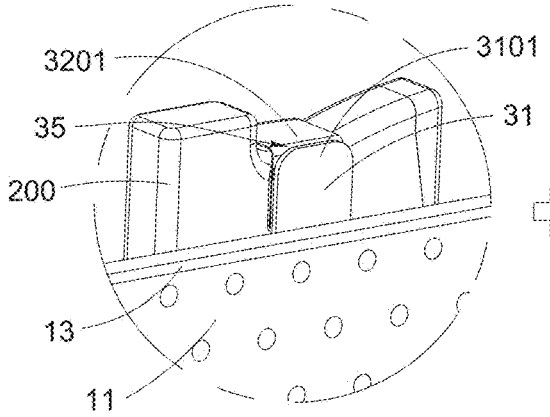
FIGS. 17A, 17B, 17C, 17D and 17E are respectively partial enlarged views of area D in FIG. 16 during a single right hand drawing operation for retrieving the handgun from the band holster according to the third alternative mode of the above preferred embodiment of the present invention.

As shown in FIGS. 17A to 17E of the drawings, the single drawing operation for retrieving the handgun 200 from the handgun pouch 21 of this alternative mode is illustrated. Referring to FIG. 17A, when the handgun 200 is placed and stored at the handgun pouch 21, the second connecting strap 32 is pulled so as to allow the mounting strap 3322 to align with the upper free end portion 3101 of the first connecting strap 31, so that the button 3310 on the outer side of the upper free end portion 3101 of the first connecting strap 31 is clasped and engaged with the buttonhole member 3320 on the outer side of the upper free end portion 3201 of the second connecting strap 32. The button 3310 is clasped on top of the buttonhole member 3320 in this alternative mode. The elastic second connecting strap 32 is in a tension state and is pulling the upper free end portion 3101 of the first connecting strap 31, and an angel can be defined between the upper free end portion 3101 of the first connecting strap 31 and the upper free end portion 3201 of the second connecting strap 32, so that a gap 35 is defined between the upper free end portion 3101 of the first connecting strap 31 and the upper free end portion 3201 of the second connecting strap 32.

Figure 17B:
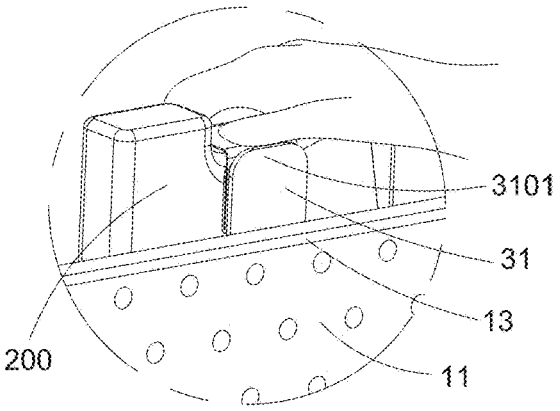

As shown in FIG. 17B, when the user is using a drawing hand, which is illustrated as a right hand, to retrieve the handgun 200, the thumb is placed at the outer side of the upper free end portion 3101 of the first connecting strap 31 above the clasp assembly 33 while the rest four fingers are placed at the outer side of the handgun pouch 21.

Figure 17C:
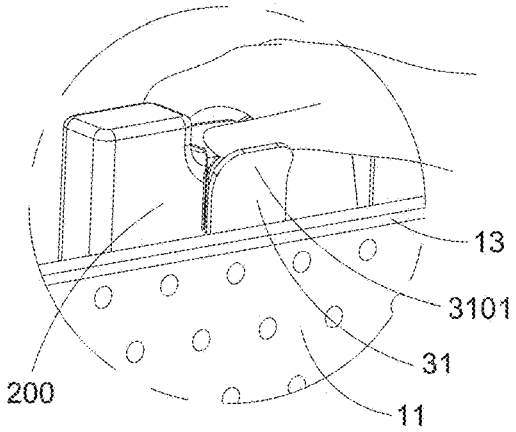
Figure 17D:
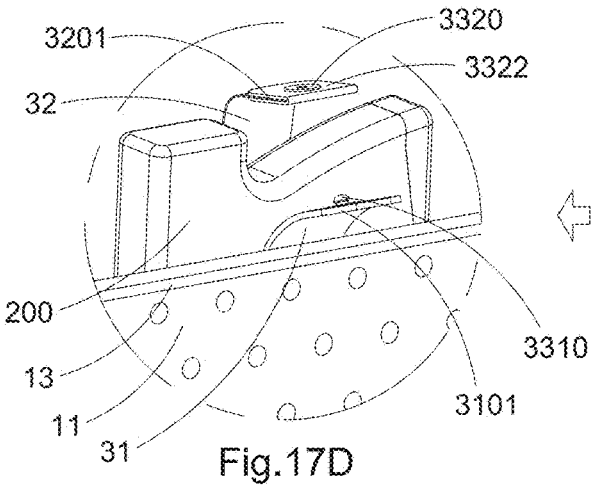
Figure 17E:
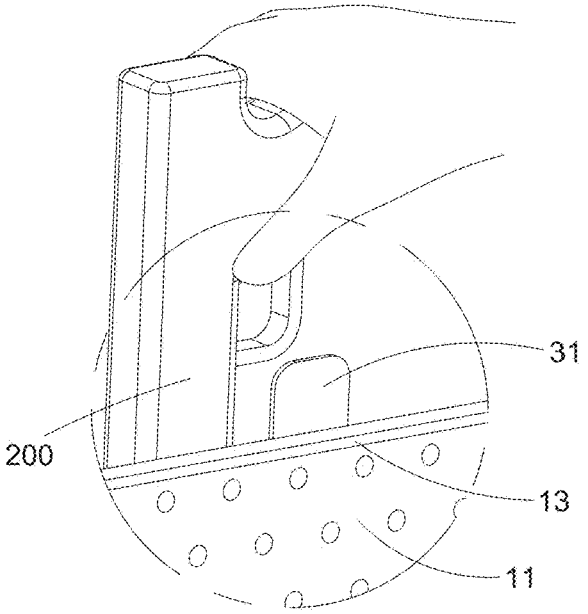

As shown in FIG. 17C, when the user is carrying out the single drawing operation of the single drawing hand, the drawing hand is moving upward to pull the handgun 200 to move upward, and at the same time, the thumb of the drawing hand is sliding along the upper free end portion 3102 of the second connecting strap 32, and then is sliding into the gap 35 between the upper free end portion 3101 of the first connecting strap 31 and the upper free end portion 3201 of the second connecting strap 32, so that the thumb between the upper free end portion 3101 of the first connecting strap 31 and the upper free end portion 3201 of the second connecting strap 32 is able to apply a toggling force to the upper free end portion 3101 of the first connecting strap 31, and thus the button 3310 is driven to move, so as to be detached from the buttonhole member 3320, as shown in FIG. 17D, and then the second connecting strap 32 automatically retracts because of its elasticity, and the clasp assembly 33 is thus shifted to the open state to allow the handgun 200 to be quickly and efficiently retrieved from the handgun pouch 21, as shown in FIG. 17E.

Figure 18:
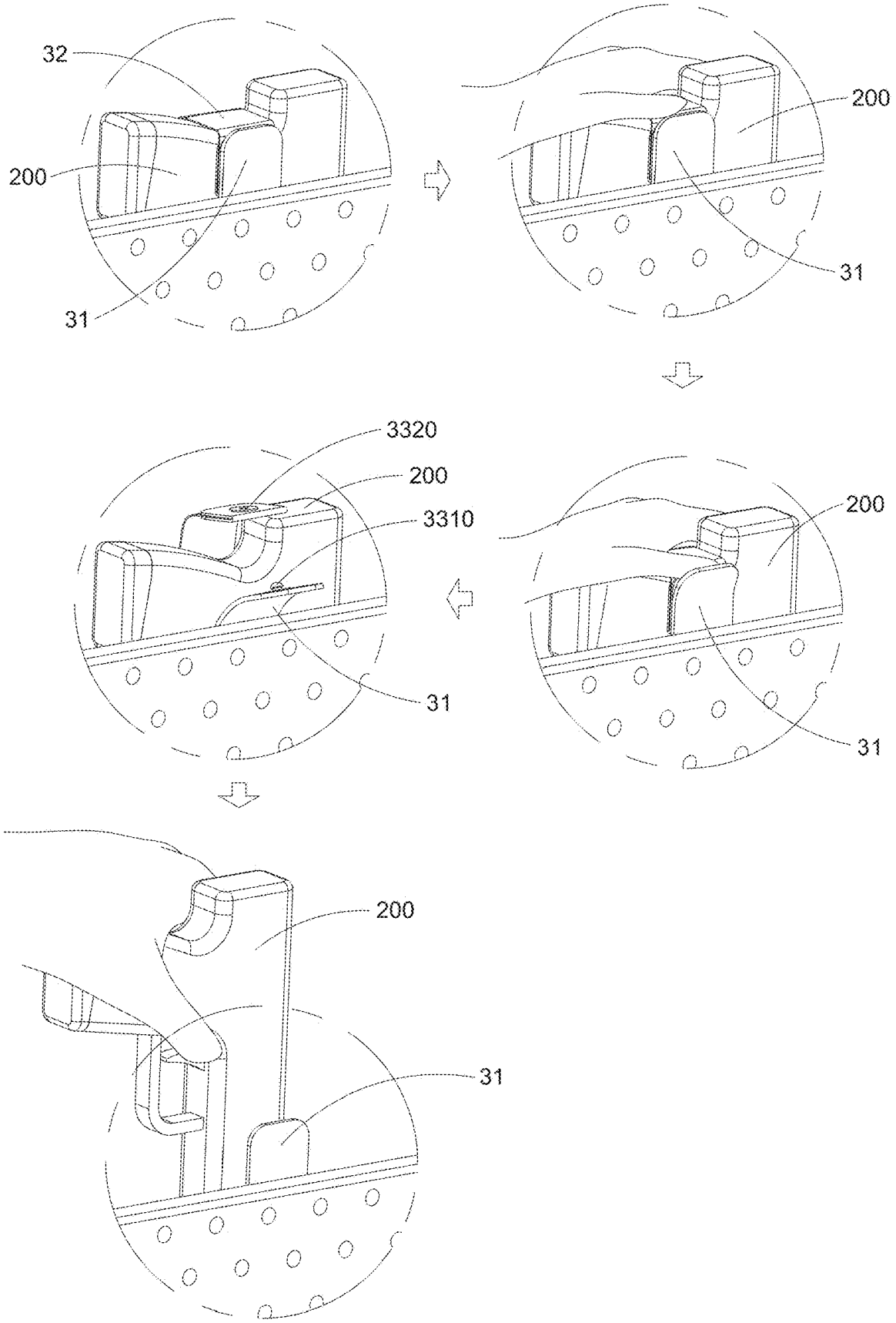
FIG. 18 illustrates a single left hand drawing operation for retrieving the handgun from the band holster according to the third alternative mode of the above preferred embodiment of the present invention.
Figure 19A:
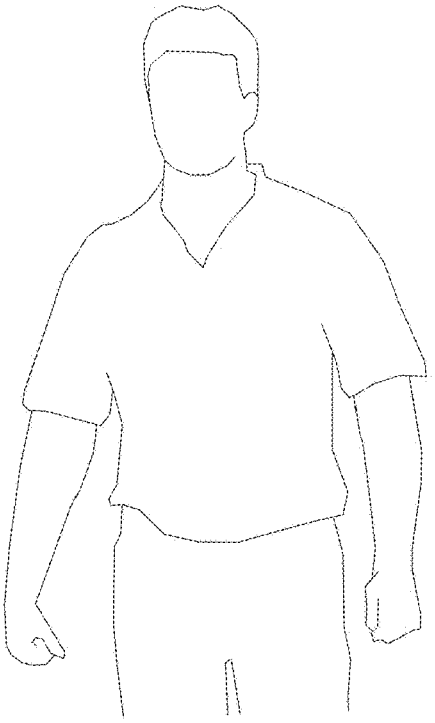
FIGS. 19A, 19B, 19C and 19D are respectively perspective views illustrating a single drawing operation for retrieving a handgun from the band holster being worn on a wait of the user according to the above preferred embodiment of the present invention.
Figure 19B:
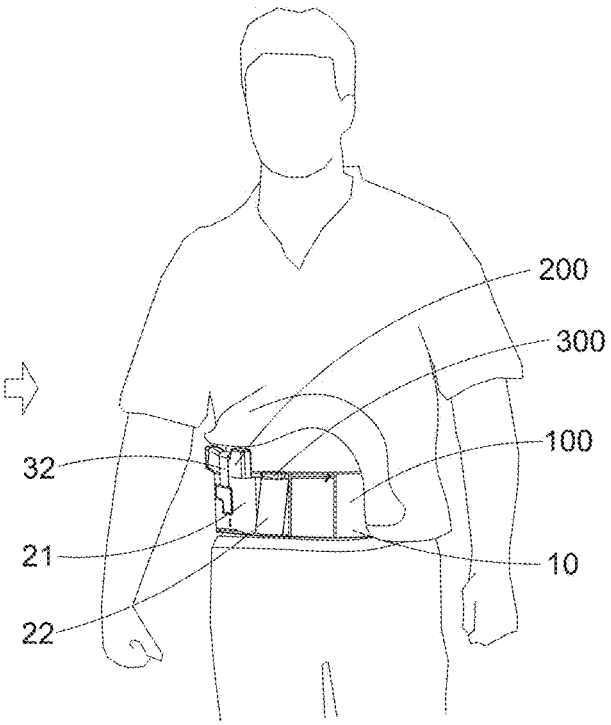
Figure 19D:
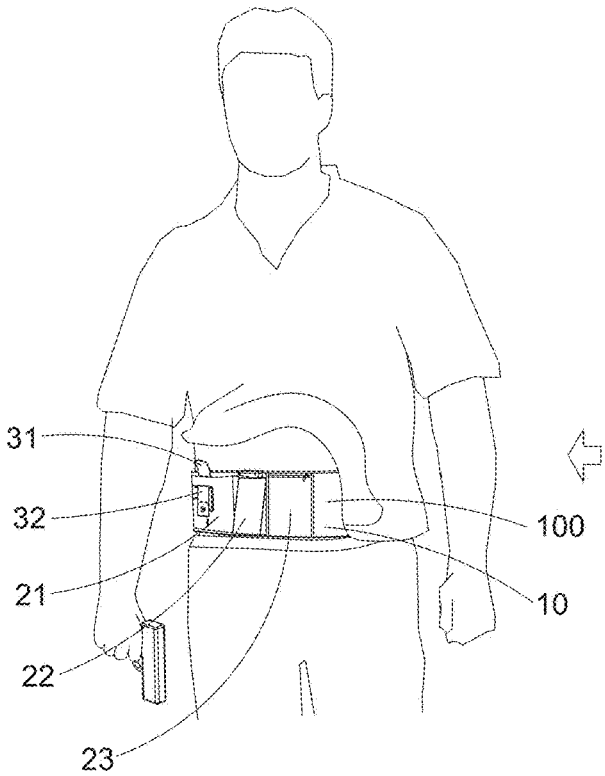
Figure 19C:
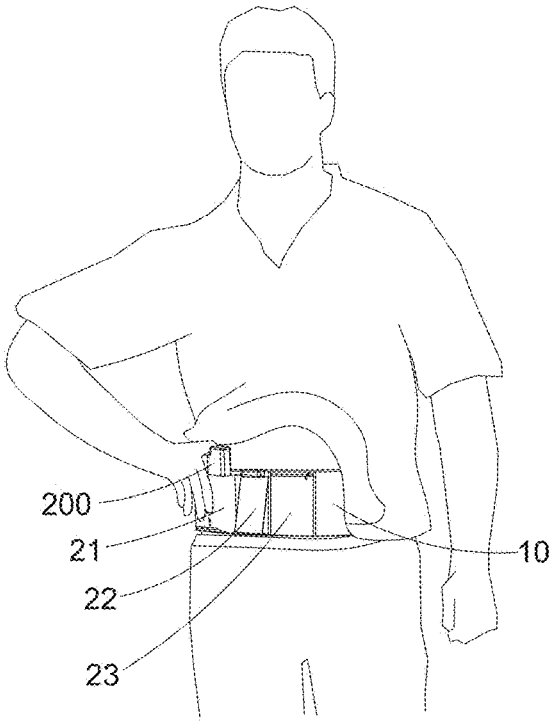

Referring to FIG. 18, when the handgun 200 is retained at the handgun pouch 21 in a different orientation with the gripping portion of the handgun 20 at a left side, the drawing hand can be a left hand of the user which is used to retrieve the handgun 200 from the handgun pouch 21 by a single left hand drawing operation.

The pouch assembly 20 further comprises one or more magazine pouches 22 form by the inner sheet 201 and the outer sheet 202. In this embodiment, two magazine pouches 22 are symmetrically formed at two opposite sides of the handgun pouch 21 for storing two magazines 300 respectively. In anther embodiment, a single magazine pouch 22 may be formed at an side of the handgun pouch 21.

In this embodiment, each magazine pouch 22 has a magazine compartment 220 which is an inclined compartment for inclinedly receiving the magazine 300. Accordingly, when the magazines 300 are respectively inserted and retained at the magazine compartments 220, the handgun 200 is inserted and placed at the handgun pouch 21, upper end portions of the magazines 300 are spaced apart from the upper portion of the handgun 200, so that there is enough space is created between the handgun 200 and the corresponding magazine 300, so that by spacing the magazines 300 away from the handgun 200, interference during the drawing operation of the handgun 200 is avoided, so as to ensure smooth and unobstructed access when retrieving the handgun.

According to this embodiment, the handgun pouch 21 and the magazine pouches 22 can be integrally formed by the inner sheet 201 and the outer sheet 202. More specifically, the pouch assembly 20 comprises two boundary seams 203 connecting the inner sheet 201 and the outer sheet 202 to define the accommodating compartment 210 formed between the inner layer 211 and the outer layer 212, so as to form the handgun pouch 21, two first inclined seams 204 connecting the inner sheet 201 and the outer sheet 202 to define a first magazine compartment 220, and two second inclined seams 205 connecting the inner sheet 201 and the outer sheet 202 to define a second magazine compartment 220, so as to form the two magazine pouches 22 at the two opposite sides of the handgun pouch 21. One of the two first inclined seams 204 which is an outer inclined seam away from the handgun pouch 21 is used to inclinedly support the magazine 300 in the corresponding first magazine compartment 220, and one of the two second inclined seams 205 which is an outer inclined seam away from the handgun pouch 21 is used to inclinedly support the magazine 300 in the corresponding second magazine compartment 220.

The pouch assembly 20 further comprises two edge seams 206 connecting the inner sheet 201 and the outer sheet 202 to mount the pouch assembly 20 to the band body 10. Accordingly, the two edge seams 206 are formed at the outer sides of the magazine pouches 22.

It can be understood that each of the above boundary seams 203, the first inclined seams 204, the second inclined seams 205 and the edge seams 206 can be a glue layer applied between the inner sheet 201 and the outer sheet 202, or is embodied as a stitching line applied on the inner sheet 201 and the outer sheet 202 so as to sew the inner sheet 201 with the outer sheet 202.

In addition, the pouch assembly 20 further comprises a sealing pouch 23 fixed to the band body 10. The sealing pouch 23 may comprises only a single pouch layer 231 which is fixed to the band body 10, the sealing pouch 23 has a slot 232 which is provided with a zipper 233 for sealing the slot 232, so that when a personal item of the user is placed into the sealing pouch 23, the zipper 233 can be operated to be in a closed state for sealing the personal item in the sealing pouch 23.

As shown in FIGS. 20 to 23, the pouch assembly 20 further comprises one or more utility pouches 24 which are detachably mounted on the band body 10 for storing magazines 300 or other person items 400 such as phones, ID cards, wallets, keys, headphones, flashlight, tissues, wet wipes and medications.

The utility pouch 24 comprises an attaching layer 241 for detachably coupling with the band body 10, a holding layer 242 connected to the attaching layer 241 to define a holding compartment 243 for receiving a personal item 400, and a connecting belt 244 for retaining the person item 400 in the holding compartment 243.

The band body 10 comprises the loop layer 121 on the base layer 11. Correspondingly, the attaching layer 241 comprises an attaching hook layer 2411 which is detachably coupled with the loop layer 121 of the band body, so that the utility pouches 24 can be securely attached and detached from the band body 10 and the utility pouches 24 can be horizontally, inclinedly, or vertically placed on a desired position of the loop layer 121 of the band body 10, offering the user the convenience of positioning the personal item 400 or magazine 300 wherever desired with a desired posture. This detachable feature not only enhances versatility but also provides customization options. Users can effortlessly attach or detach pouches according to their needs, allowing for quick access and efficient organization of essentials.

As an example, the holding layer 242 can be an integral fabric strap 2420 which is sewn to the attaching layer 241 by two lateral sewing seams and a bottom sewing seam. The holding layer 242 may also comprise two transverse straps 2421 each having two ends connected to an upper end portion or a lower end portion of the attaching layer 241, a longitudinal strap 2422, which has a width smaller than a width of each transverse strap 2421, connected to the two transverse straps 2421 to define two side openings 2423 communicated to the holding compartment 243 respectively, this configuration is able to allow the holding compartment 242 with the two side opening 2423 to adapt to difference widths of the personal item 400 or magazine 300.

In this embodiment, the connecting belt 244 comprises two end portions 2441 and a body portion 2442 between the two end portions 2441, and at least one of the two end portions 2441 is detachably coupled with one of the attaching layer 241 and the holding layer 242 for retaining the personal item 400 or the magazine 300.

Figure 22:
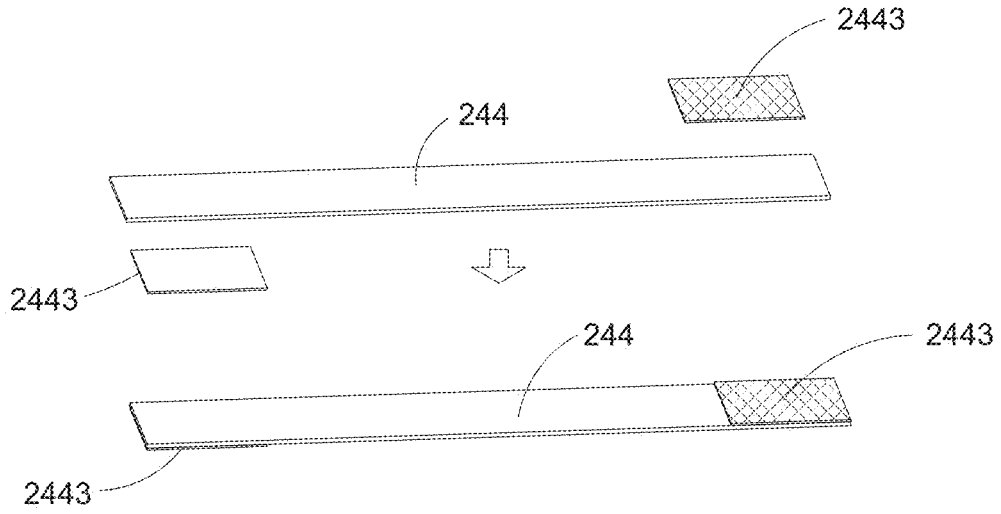
FIG. 22 is a perspective view illustrating a structure of a connecting belt of the utility pouch of the band holster according to the above preferred embodiment of the present invention.
Figure 23:
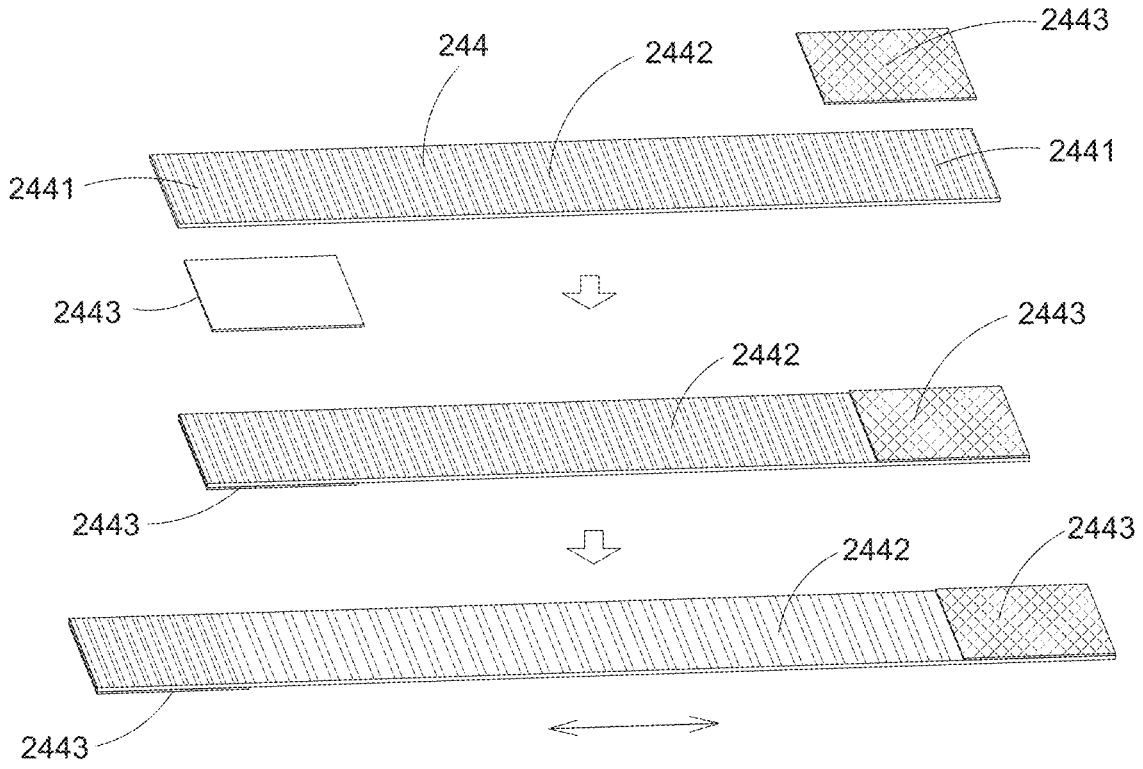
FIG. 23 is a perspective view illustrating a structure of another connecting belt of the utility pouch of the band holster according to the above preferred embodiment of the present invention.

The connecting belt 244 can be a fabric strap which does not have elasticity, as shown in FIG. 22. Alternatively, as shown in FIG. 23, the connecting belt 244 is an elastic belt that is stretchable, so that when the personal item 400 or magazine 300 is placed in the utility pouch 22, the connecting belt 244 is pulled and stretched to adapt to different lengths of the personal item 400 or the magazine 300.

Figure 20:
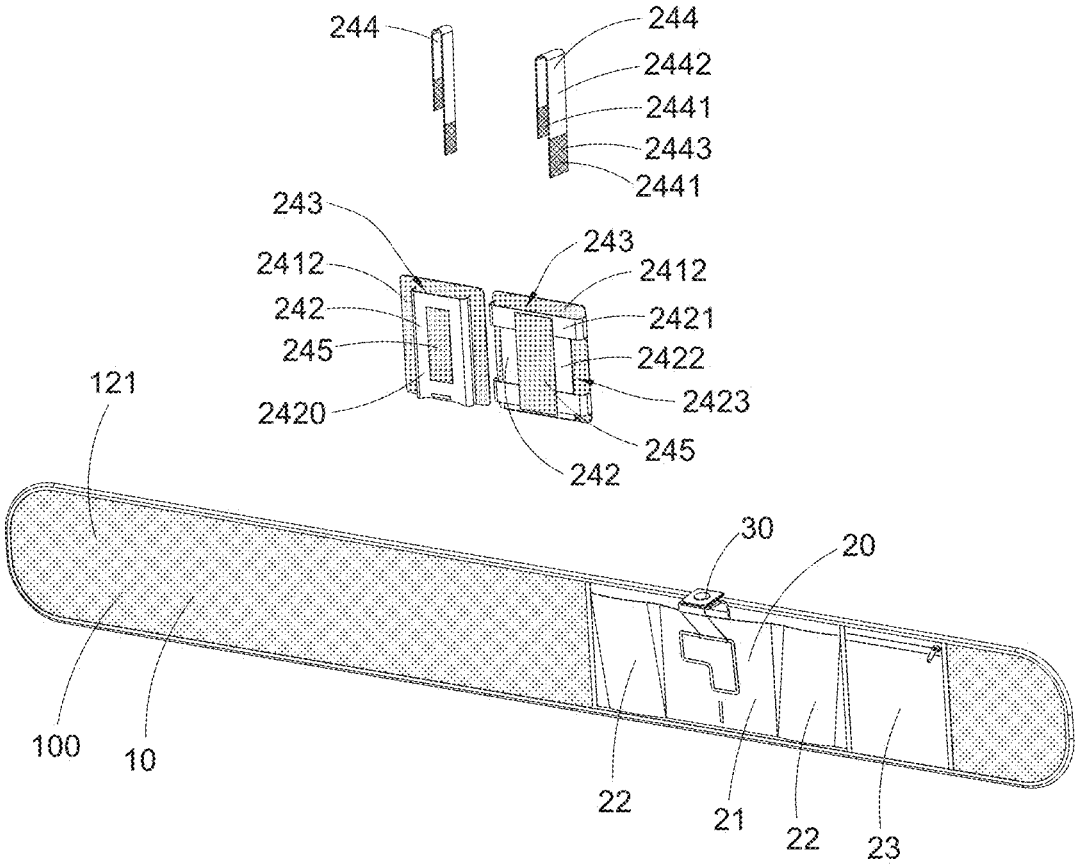
FIG. 20 is a perspective view illustrating a front side of utility pouches of the band holster according to the above preferred embodiment of the present invention.

As shown in FIG. 20 of the drawings, the attaching layer 241 comprises an installing loop layer 2412 facing the holding layer 242, and the utility pouch 24 further comprises a mounting loop layer 245 formed on the holding layer 242. The connecting belt 244 comprises two end hook layers 2443 attached to the two end portions 2441 of the connecting belt 244 at two opposite sides of the connecting belt 244 so as to detachably coupling with the installing loop layer 2412 and the mounting loop layer 245 respectively, so that both of the positions of the end hook layers 2443 can be adjusted, so as to adapt to different lengths of the personal item 400 or the magazine 300. As a specific example, the connecting belt 244 with the two end hook layers 2443 and the elastic body portion 2442 is able to wrap and tightly fasten a phone having a variety of lengths.

Figure 24:
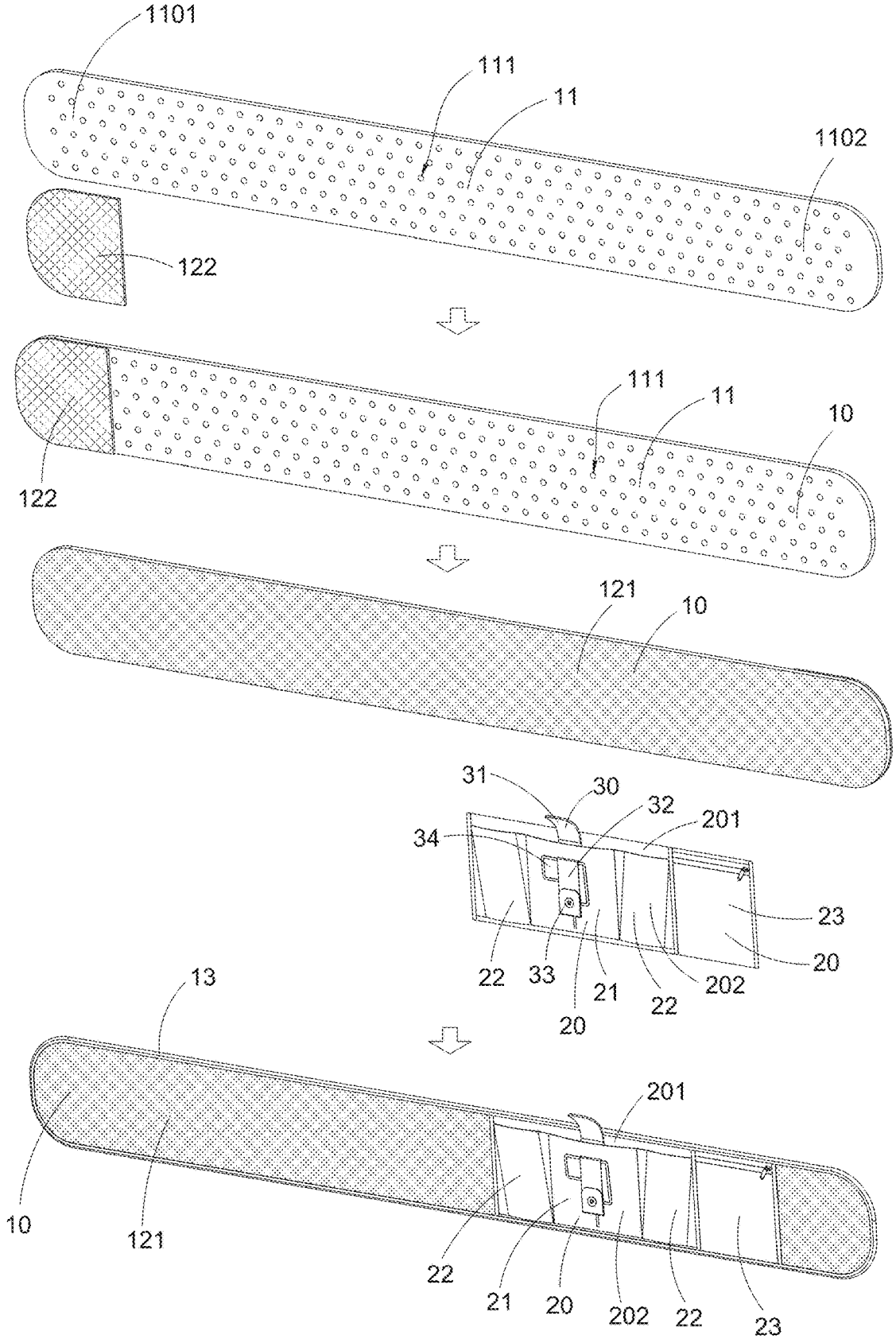
FIG. 24 is a perspective view illustrating a manufacturing process of the band holster according to the above preferred embodiment of the present invention.

Referring to FIG. 24, of the drawings, a manufacturing method of the band holster 100 according the preferred embodiment of the present invention is illustrated. The manufacturing method comprises a step of preparing the band body 10, a step of preparing the pouch assembly 20, and a step of fixing the pouch assembly 20 to the band body 10.

In the step of preparing the band body 10, the base layer 11 formed with the loop layer 121 is sewn with the hook layer 122 at the first end portion 1101 of the base layer 11.

In the step of preparing the pouch assembly 20, the inner sheet 201 and the outer sheet 202 are sewn together along the boundary seams 203, the first inclined seams 204, the second inclined seams 205, the edge seams 206 and the connecting seam 214, so as to form the handgun pouch 21 and the magazine pouches 22.

When mounting the pouch assembly 20 with the band body 10, the pouch assembly 20 is placed on the band body 10, and then the edge wrapping layer 13 is wrapped along the perimeter of the base layer 11, the loop layer 121, and the upper and lower edges of the pouch assembly 20, so as to mount the pouch assembly 20 to the band body 10.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and are subject to change without departure from such principles. Therefore, this invention includes all modifications encompassed within the spirit and scope of the following claims.

What is claimed is:

1. A band holster, comprising:

a band body;

a handgun pouch connected to said band body, wherein said handgun pouch has an accommodating compartment for holding a handgun; and a clasp means which is capable of being operated between a closed state for retaining the handgun at said handgun pouch and an open state for allowing the handgun to be retrieved from said handgun pouch;

wherein said clasp means is coupled to said handgun pouch and is configured to allow a single drawing operation of a single hand of the user to release said clasp means and retrieve the handgun from said handgun pouch;

wherein said handgun pouch comprises an inner layer connected to said band body, and an outer layer connected to said inner layer to define said accommodating compartment with a top opening communicated to said accommodating compartment, wherein said clasp means comprises a first connecting strap connected to said inner layer of said handgun pouch, a second connecting strap connected to said outer layer of said handgun pouch, and a clasp assembly which comprises a first clasp element connected to said first connecting strap, and a second clasp element connected to said second connecting strap, wherein said first clasp element is detachably coupled with said second clasp element for retaining the handgun at said accommodating compartment in said closed state and allows the handgun to be retrieved out through said top opening of said handgun pouch by the single drawing operation;

wherein said first clasp element is a button which is mounted to an upper free end portion of said first connecting strap, wherein said second clasp element is a buttonhole member which is mounted to an upper free end portion of said second connecting strap;

wherein when said clasp assembly is in the closed state for retaining the handgun at said accommodating compartment, a gap is defined between said upper free end portion of said first connecting strap and said upper free end portion of said second connecting strap, so as to allow a thumb of the hand of the user to slide into the gap to cause said clasp assembly to be released during the single drawing operation;

wherein said second connecting strap is an elastic strap, wherein said first connecting strap is in an upright state when said clasp assembly is in the open state;

wherein said first connecting strap is mounted to an inner surface of said inner layer of said handgun pouch, wherein said second connecting strap is mounted to an outer side of said outer layer of said handgun pouch;

wherein said button comprises a button seat which is embedded into said upper free end portion of said first connecting strap, and a button pin which is protruded from said button seat, wherein said button pin comprises an enlarged head portion and a circular clasping groove adjacent to said enlarged head portion, wherein said buttonhole member comprises a mounting strap which is folded to provide two strap layers which are clamping said upper free end portion of said first connecting strap to form a sandwich structure, a base plate attached to one of said strap layers, and a retention component attached to the other strap layer, wherein said retention component has a retention hole for engaging with said button pin and has an access opening which is communicated to said retention hole, wherein two retention pins are mounted in said access opening and are spaced apart from each other to allow said enlarged head portion of said button pin to be squeezed into said retention hole until said two retention pins are engaged with said circular clasping groove.

* * * * *